US006672127B2

(12) United States Patent
Maida

(10) Patent No.: US 6,672,127 B2
(45) Date of Patent: Jan. 6, 2004

(54) METAL SHEET BENDING DEVICE WITH ROTATION INHIBITING FUNCTION

(75) Inventor: Takaaki Maida, Oota-ku (JP)

(73) Assignee: Yuugenkaisha Taigaa Koosan, Tokyo (JP)

( * ) Notice: Subject to any disclaimer, the term of this patent is extended or adjusted under 35 U.S.C. 154(b) by 0 days.

(21) Appl. No.: 10/049,619

(22) PCT Filed: Apr. 27, 2001

(86) PCT No.: PCT/JP01/03737

§ 371 (c)(1),
(2), (4) Date: Feb. 22, 2002

(87) PCT Pub. No.: WO01/97993

PCT Pub. Date: Dec. 27, 2001

(65) Prior Publication Data

US 2002/0104363 A1 Aug. 8, 2002

(30) Foreign Application Priority Data

Jun. 23, 2000 (JP) ..... 2000-188763
Jul. 12, 2000 (JP) ..... 2000-211152

(51) Int. Cl.[7] ..... B21D 5/01; B21D 7/06; B21D 22/02

(52) U.S. Cl. ..... 72/389.4; 72/396; 72/387

(58) Field of Search ..... 72/389.3, 389.4, 72/389.8, 396, 383, 387

(56) References Cited

U.S. PATENT DOCUMENTS 2,916,073 A * 12/1959 Johnson ..... 72/389.4
5,060,501 A * 10/1991 Heath ..... 72/389.4
5,365,766 A * 11/1994 Takahashi et al. ..... 72/387

FOREIGN PATENT DOCUMENTS

| | | | |
|---|---|---|---|
| JP | 0576141 | * 10/1977 | ..... 72/389.4 |
| JP | 362158527 | * 7/1987 | ..... 72/389.4 |
| JP | 363036923 | * 2/1988 | ..... 72/389.4 |
| JP | 63-199028 | * 8/1988 | ..... 72/389.4 |
| JP | 403124317 | * 5/1991 | ..... 72/389.4 |
| JP | 7-335807 | 12/1995 | |
| JP | 8-1245 | 1/1996 | |
| JP | 10-166060 | 6/1998 | |
| JP | 10-296336 | 11/1998 | |

* cited by examiner

*Primary Examiner*—David Jones
(74) *Attorney, Agent, or Firm*—Oblon, Spivak, McClelland, Maier & Neustadt, P.C.

(57) ABSTRACT

A metal sheet bending apparatus includes first and second lower bar molds each having a section of a semicircular shape. The first and second lower bar molds are rotatably provided in first and second concave portions of a support, respectively. First and second adjust screws are attached to first and second pull-up rods, respectively at an opposite side of the portions with respect to first and second stoppers. An upper mold is adapted to bend a metal sheet placed on metal contact surfaces of the first and second lower bar molds by pressing the metal sheet above a groove of the support while the first and second lower bar molds rotate against spring force given by first and second push springs such that the metal contact surfaces form a V-shape.

12 Claims, 13 Drawing Sheets

METAL SHEET BENDING DEVICE WITH ROTATION INHIBITING FUNCTION

TECHNICAL FIELD

The present invention relates to the apparatus for bending metal plates by the use of special metal molds. Particularly, this apparatus is characterized in that it is provided with the rotary control function, cushion materials, etc. Such apparatus is used as a bender for bending metal plates (press brake), oil pressure press, air pressure press, mechanical press, etc.

In addition, the present invention relates to the apparatus for bending metal plates in U-shape by the use of two (2) lower bar molds semicircular in section. This apparatus is characterized in that the tip-rounded upper mold is used, the lower bar molds are provided with rotary control function and that the odd part/parts of lower bar molds are cut off to form an odd pressing part/parts. Such apparatus is used as a bender for bending metal plates (press brake), oil pressure press, air pressure press, mechanical press, etc. in a U shape, such metal plates bent being used for buildings, kitchens, rail-guides, cooling fans, oval pipes, etc.

BACKGROUND ART

Regarding the apparatus for bending metal plates by the use of metal molds, such as, for an example, "a bender", there have been conventionally used the lower plane molds provided with a groove thereon and the upper punching mold. The metal plate is placed on the groove on the lower plane molds. Then, the metal plate is pressed into the groove of the lower mold and thereby bent.

However, there are disadvantages in the above apparatus. Since the groove between the lower plane molds is limited in size and shape, several scores of the lower plane molds provided with the different size and shape of grooves are required to be prepared for taking care of the different thickness of the metal plate to be bent and the different bending degree required. This causes a larger cost in equipment. Not only that, but a space is required for storing such number of the lower plane molds. This is a problem in terms of space economy. Furthermore, the lower mold is required to be changed, whenever necessary, depending upon the purpose for which it is used. Thus, the above apparatus is labor-consuming and lowers an operational efficiency.

Particularly, when the thin metal plate is bent, the acute bending accuracy desired is not likely to be obtained because the tip part of the groove is too wide. When the thick metal plate is bent, scratches are liable to be formed on the surface of the metal plate, because the groove gets tight in its tip part.

In addition, the pressure of the upper mold is rectangularly, by way of the metal plate, imposed on the groove between the lower plane molds. As there is no pressure relief, an excessive pressure causes the friction between the surface of the metal plate and the groove surface of the lower mold. Thus, there are formed scratches on the surface of the metal plate. Such scratches produce the inferior appearance on the products made of the metal plate bent in such manner. This is another disadvantage.

Furthermore, as the pressure of the upper mold is linearly concentrated on the surface of the metal plate with the groove between the lower molds at the supporting point, the physical texture of the metal plate is damaged and deteriorated. Thus, cracks are produced therein. The physical strength thereof is lowered. When, particularly, the shoulder R of the metal plate is small, this defect is conspicuously developed.

Furthermore, the stroke of the upper mold reaches the lower dead point and bends the metal plate. Because of this mechanism, the strong pressure of the upper mold is directly transferred to the groove between the lower molds. Thus, the impact thereof is large. Scratches and damages are caused on the groove surface between the lower plane molds. The groove between the lower mold tends to be abraded and worn out. These are the disadvantages of the conventional molds.

Furthermore, the metal plate is placed on the groove between the lower plane molds and then bent by pressing it down by the upper mold. When the tip part of the metal plate is bent or when the bending length is too short, the metal plate tends to get out of place. Even when the tip part of the metal plate can be bent, the bending accuracy thereof tends to be insufficient or unsatisfactory.

Then, we have made a considerable study of the conventional apparatus for bending metal plates. As a result, there has been developed the apparatus for bending metal plates involving the use of entirely new special lower molds. The patent application has been filed for it (Application No. Hei-10-373221). Thus, there have been overcome the aforementioned problems and disadvantages of the conventional apparatus for bending metal plates.

Referring to the metal bending apparatus involving the use of the special lower molds, the metal mold comprises the ordinary upper punch mold 1 and two (2) lower bar molds 2*a* and 2*b* semicircular in section having metal contact surfaces 3*a* and 3*b* on their surfaces, as shown in FIG. 1. Further, the reverse surfaces 5*a* and 5*b* of these two (2) lower bar molds are placed so as to rotate slidably, as shown in FIG. 2, on the two (2) concave surfaces, having the groove 7 in between, formed on the support 4.

Then, referring to the metal plate 8 bending mechanism, the metal plate 8 is placed on the metal contact surfaces 3*a* and 3*b* of two (2) lower bar molds 2*a* and 2*b*. As shown in FIG. 3, the metal plate 8 is downwardly pressed by the upper mold 1. Simultaneously, the metal contact surfaces 3*a* and 3*b* of two (2) lower bar molds 2*a* and 2*b* are caused to rotate inwardly and the metal plate 8 is bent in V-shape.

As mentioned above, the metal plate bending apparatus involving the use of the special lower mold is unlike the conventional plane lower molds. Thus, it is not required to use scores of plane lower molds different in size and shape, depending upon the thickness of metal plates to be bent. It is provided with such function as to bend metal plates to an optional degree by the use of lower molds comprising one or a few sets of lower bar molds 2*a* and 2*b*. Because of this function, facility cost is lowered and a storing place is made smaller. There is no need to change lower molds. Thus, operational efficiency, etc. is improved. These are advantages thereof.

Further, when bending the metal plate 8, the downward pressure of the upper mold 1 is reduced. Thereby, the downward pressure of the upper mold 1 is caused to run off by way of the metal plate 8. Thus, there would be produced no scratches on metal plates 8 to be caused by the friction of the metal plate 8 against the lower bar molds 2*a* and 2*b*. Thus, the metal 8 has a good outer appearance.

However, when bending the thick metal plate 8 by the downward pressure of the upper mold 1, the metal contact surfaces 3*a* and 3*b* tends to run off the metal plate 8, probably because the lower bar molds 2*a* and 2*b* are rotated too smoothly. As shown in FIG. 4, while the bending angle of the metal plate 8 remains insufficient, the metal plate 8 separates from the metal contact surfaces 3*a* and 3*b*. The bent part of the metal plate 8 gets into the groove. The bending angle (R) of the metal plate 8 comes to be insufficient and the desired angle is not satisfactorily obtained. Thus, it is not bent neatly and the bending accuracy is lowered. These are disadvantages of the conventional apparatus.

Furthermore, when attempting to bend the metal plate 8 at an acute angle of less than 90° by the aforementioned metal plate bending apparatus, the adjacent parts on the metal contact surfaces of two (2) lower bar molds tend to get apart from each other, as shown in FIG. 4. Thus, the bending angle of metal plate gets loose. Therefore, it was difficult to bend the metal plate 8 at an acute angle of less than 90°.

In addition, when attempting to bend the metal plate 8 by the aforementioned metal plate bending apparatus, the metal plate 8 is pressed on the metal contact surfaces 3*a* and 3*b* of the lower bar mold 2*a* and 2*b* thereunder by the upper mold 1. Because of such pressure, scratches, slit scars, etc. are caused by the friction on the lower surface of the metal plate 8, namely, the surface which comes into contact with the metal contact surfaces 3*a* and 3*b* of the lower bar molds 2*a* and 2*b*. This causes the quality of products lowered. In worst case, products become incapable of being placed on the market.

Further, after the stroke of the upper mold 1 reaches the lower dead point and bends the metal plate 8, the upper mold 1 is caused to return to the original position. Then, the bent metal plate 8 is taken out from the bottom. It is required that the lower bar molds 2*a* and 2*b* be caused to rotate inversely so that the metal contact surfaces 3*a* and 3*b* may return to the horizontal position. But, in many cases, the lower bar molds 2*a* and 2*b* are not capable of being satisfactorily restored to their original positions by their own weight alone. Their restoration requires manual labor. Thus, work inefficiency is lowered. This is another disadvantage.

Further, as mentioned above, there has been the metal bending apparatus involving the use of the upper mold and plane lower molds, such as a bender. This apparatus has been capable of bending a metal plate in V-shape by placing the metal plate on the metal contact surface of plane lower mold and pressing the same metal plate against the plane lower mold. However, for bending the metal plate in U-shape, this apparatus is absolutely required to use several kinds of upper molds and plane lower molds and go through several manufacturing processes. In other words, there has been no apparatus for bending the metal plate in U-shape by the use of the single set of the upper mold and lower mold as well as the single process.

Unlike the conventional metal bending apparatus, the lower plane mold of the present invention is not required to use scores of plane molds in different size and shape. The rotation of two (2) lower bar molds is controlled by the use of one or a few pairs of rotary lower bar molds having such rotary control function as a spring, etc. and then the surface of the metal plate is tightly attached to the metal contact surfaces of two (2) lower bar molds. The downward pressure of the upper mold is properly given to the metal plate. Thus, the metal plate is bent neatly and accurately, adjusting the bending angle (R) thereof in accordance with the object for which it is to be used. Thus, the bending performance thereof is improved. Herein lies the main object of the present invention.

Further, when bending the metal plate by the use of two (2) lower bar molds, the acute bending angle is formed in V-shape on the metal contact surfaces of the lower bar molds. Thereby, the metal plate may be bent at an acute angle of less than 90°. This is another object of the present invention.

The further object of the present invention is that, when bending the metal plate by pressing the metal plate on the metal contact surfaces of the lower bar molds, there is formed a cushion material surface, sliding surface or sintered carbide surface on the metal contact surfaces of the lower bar mold. Thereby, the formation of scratches, slit scars, etc. is prevented on the lower surface of the metal plate. Thus, the products made of such metal plate bent has a good outer appearance.

Furthermore, there are caused a plurality of units to coexist lengthwise in one row, such units being loaded on the support provided with two (2) concave surfaces. Thereby, it becomes possible to bend the lengthy metal plate which could not be bent by the conventional metal bending apparatus. Herein lies one of the objects of the present invention Further, the metal contact surfaces of two (2) lower bar molds are not required to be manually restored to the horizontal position. The metal contact surfaces of two (2) lower bar molds are automatically caused to turn inversely and return to the horizontal position. Herein lies likewise one of the objects of the present invention.

Unlike the conventional lower plane mold, the lower plane mold of the present invention is not required to use scores of plane molds different in shape and size for meeting with the required thickness or bending angle of the metal plate to be bent. The metal plate may be optionally bent by the use of one or a few pairs of lower bar molds. Thereby, the equipment cost is reduced and the storing place is made unnecessary or minimized. Further, the present invention makes it unnecessary to change lower molds and thereby improves work performance. This is also one of the objects of the present invention.

The further object of the present invention is that, by receiving the pressure of the upper mold at the entire metal contact surfaces of two (2) lower bar molds, such pressure is dispersed and thereby the physical texture of the metal plate is made free from any damage or deterioration. Thereby, cracks are prevented from being formed on the metal plate. Thus, the physical strength of the metal plate is maintained and the stronger metal plate product is made.

The further main object of the present invention is that the rotation of the two (2) lower bar molds are controlled by the use of one or a few pairs of rotary lower bar molds provided with such rotary control function as a press spring, etc., and the metal plate surface is caused to tightly attach to the metal contact surfaces of two (2) lower bar molds. Thus, the pressure of the tip-rounded upper mold is properly given to the metal plate. Thus, the bending angle (R) of the metal plate is adjusted in accordance with the object for which it is to be used. Thus, the bending performance thereof is improved.

When the metal plate is bent in U-shape by pressing the metal plate on the metal contact surfaces of the lower bar molds and by using the tip-rounded upper mold, there is formed a cushion material surface, sliding surface or sintered carbide surface on the metal contact surface of lower bar mold. Thereby, scratches, slit scars, etc. are prevented from being formed on the lower surface of the metal plate. This contributes to improvement in the outer appearance of the metal plate bent in U-shape. This further contributes to improvement in the quality of bent metal plate products. Herein lies the further object of the present invention.

DISCLOSURE OF INVENTION

The present invention relates to the apparatus provided with rotary control function for bending metal plates. There are prepared two (2) lower bar molds semicircular in section. The reverse convex surfaces of two (2) lower bar molds are placed in such manner as to slidably rotate on the support provided with two (2) concave surfaces having the groove in the intermediate thereof. The upper end of the pull-up rod is rotatively attached to the rims or reverse convex surfaces of two (2) lower bar molds. Each pull-up rod is projectively placed on the side of the support, running through the stopper, provided on the support. The push spring is set on the projection of each pull-up rod. Simultaneously, a fixture is attached to the lower end of each pull-up rod. The push spring set on each pull-up rod is retained by the stopper and the fixture. In such state, it is attached to the side of the support. The metal plate is placed on the metal contact surfaces of two (2) lower bar molds. The metal plate is pressed on the lower bar molds by the upper mold. The metal contact surfaces of two (2) lower bar molds are caused to rotate in V-shape for bending the metal plate. In connection therewith, the pull-up rod attached to the support is raised against the resilience of the push spring. Further, the rotation of metal contact surfaces of two (2) lower bar molds are controlled by the rotary control force of the push spring. Thus, the metal plate is neatly and nicely bent. Herein lies the feature of the present invention.

In addition, the adjust screw is slidably attached in such manner as to move vertically, in stead of the fixture to the lower end of each pull-up rod of the aforementioned apparatus of the present invention provided with rotary control function for bending metal plates. The position of the adjust screw is moved, depending upon the bending condition of metal plates. Thus, according as the bending condition of metal plates, the metal plate is neatly and nicely bent. This is one of the feature of the present invention.

Furthermore, cushion material surface is put, or sliding surface or sintered carbide surface is formed on the metal contact surfaces of two (2) lower bar molds of the aforementioned apparatus of the present invention provided with rotary control function for bending metal plates. Thus, the formation of scratches, scars, etc. is prevented on the lower surface of the metal plate. Thus, the product quality thereof is improved. This is one of the features of the present invention.

Furthermore, an acute angle of V-shape is formed in section on the adjacent parts between metal contact surfaces of two (2) lower bar molds of the aforementioned apparatus of the present invention provided with rotary control function for bending metal plates. Thus, the bending angle of the metal plate may be made at an acute angle of less than 90°. This is one of the features of the present invention.

Furthermore, there is made as one unit the aforementioned apparatus of the present invention provided with rotary control function for bending metal plates. A plurality of these units are caused to coexist lengthwise in one row for bending the lengthy metal plate. This is one of the features of the present invention.

Furthermore, the present invention relates to the apparatus provided with rotary control function for bending metal plates in U-shape. There are lengthwise cut off the odd adjacent parts in L-shape between the metal contact surfaces of two (2) lower bar molds semicircular in section and the odd press parts are formed. The reverse concave surfaces of two (2) lower bar molds semicircular in section are loaded in such manner as to rotate slidably on the support provided with two (2) concave surfaces having the groove in the intermediate thereof. The upper end of pull-up rod is rotatively attached to rims or convex surfaces of two (2) lower bar molds. Each pull-up rod is projectively placed on the side of the support, running through the stopper provided on the support. The push spring is set on the projection of each rod. Simultaneously, the fixture is attached to the lower end of each pull-up rod. The push spring set on each pull-up rod is retained by the stopper and the fixture and, in such state, is attached to the side of the support. The metal plate is placed on the metal contact surfaces of two (2) lower bar molds. The metal plate is pressed on the lower bar molds by the tip-rounded upper mold. After the first stage bend of the metal plate in U-shape, the odd press parts of two (2) lower bar molds are caused to rotate and, for the second stage bend of the metal plate, the pull-up rod attached to the support is lifted up against the resilience of the push spring. The rotation of the odd press parts of two (2) lower bar molds is controlled by the rotary control force of the push spring. Thus, the metal plate is neatly bent in U-shape. This is another feature of the present invention.

In addition, the adjust screw is slidably attached in such manner as to move vertically, in stead of the fixture, to the lower end of each pull-up rod in the aforementioned apparatus of the present invention provided with rotary control function for bending metal plates in U-shape. According as the U-shape bending condition of the metal plate, the position of the adjust screw is caused to move and the rotary control force of the lower bar mold by the resilience of the push spring is adjusted by the change in the position of the adjust screw. Accordance as the bending condition of the metal plate, the metal plate is properly and neatly bent in U-shape. This is one of the features of the present invention.

Further, cushion material sheet, sliding surface or sintered carbide surface is formed on the metal contact surface/s, or either or both odd press parts of two (2) lower bar molds in the aforementioned apparatus of the present invention provided with rotary control function for bending metal plates in U-shape. Thus, the formation of scratches, etc. is prevented on the lower surface of the metal plate. Thereby, this contributes to improvement in the metal plate as a product. This is one of the features of the present invention.

Furthermore, there is made as one unit the aforementioned apparatus of the present invention provided with rotary control function for bending metal plates in U-shape. A plurality of these units are caused to coexist lengthwise in one row. Thereby, the lengthy metal plate is bent in U-shape. This is one of the features of the present invention.

BEST EMBODIMENT OF INVENTION

Figure 1:
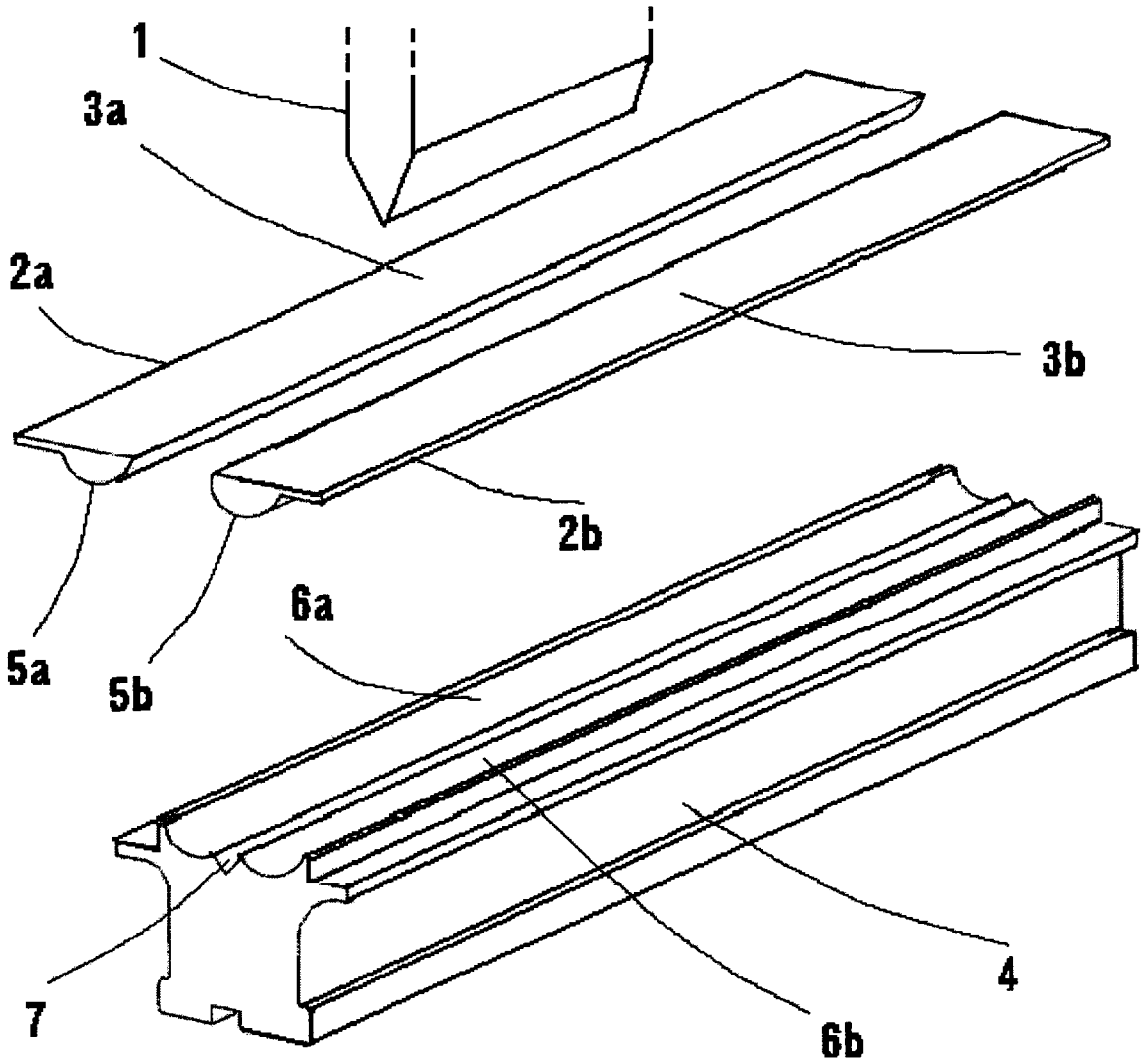
FIG. 1 is a view in extend elevation in perspective of the conventional apparatus for bending metal plates comprising the lower bar molds and the support.
Figure 2:
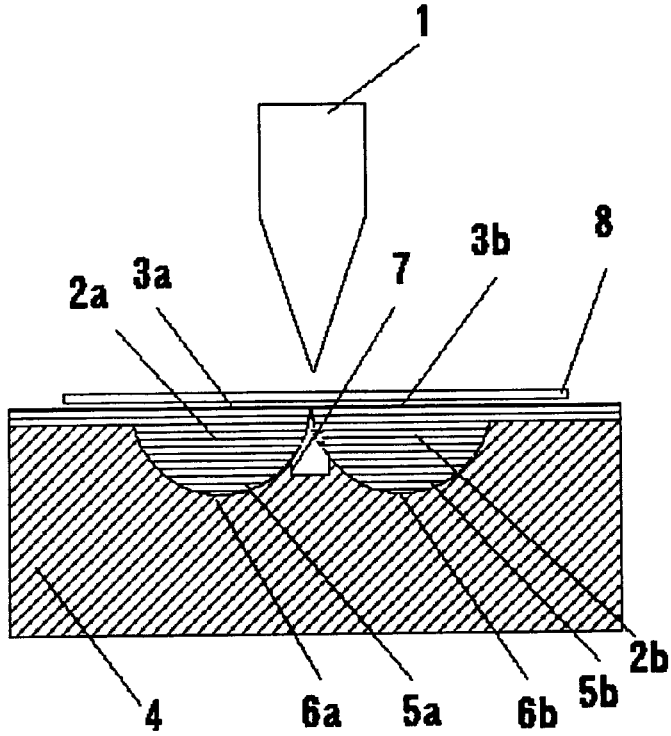
FIG. 2 is a view in section of the conventional apparatus for bending metal plates showing that lower bar molds are slidably placed in such manner as to rotate on the concave surfaces of the support for bending metal plates.
Figure 3:
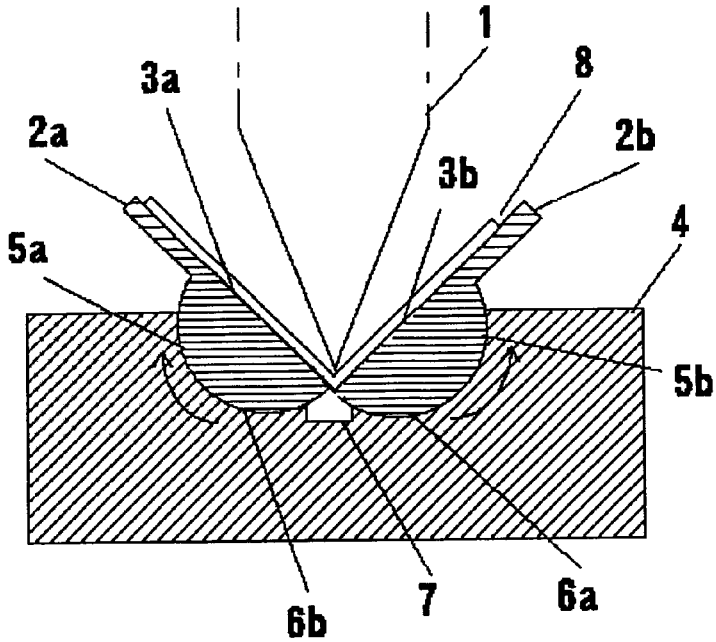
FIG. 3 is a view in section of the conventional apparatus for bending metal plates showing that lower bar molds are caused to rotate slidably by the pressure of the upper mold and thereby the metal plate is bent.
Figure 4:
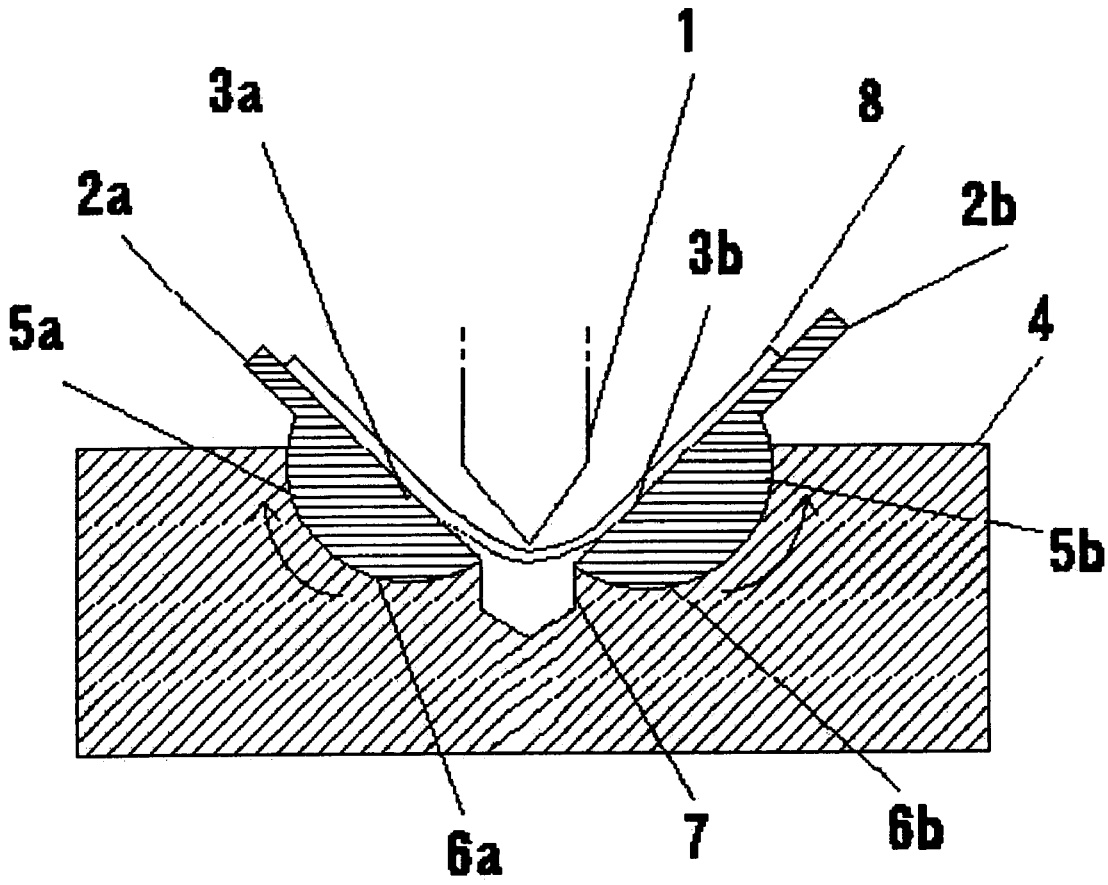
FIG. 4 is a view in section of the conventional apparatus for bending metal plates showing that, when bending the metal plate, the metal contact surfaces of lower bar molds run off the metal plates and the bending angle of the metal plates become inaccurate.
Figure 5:
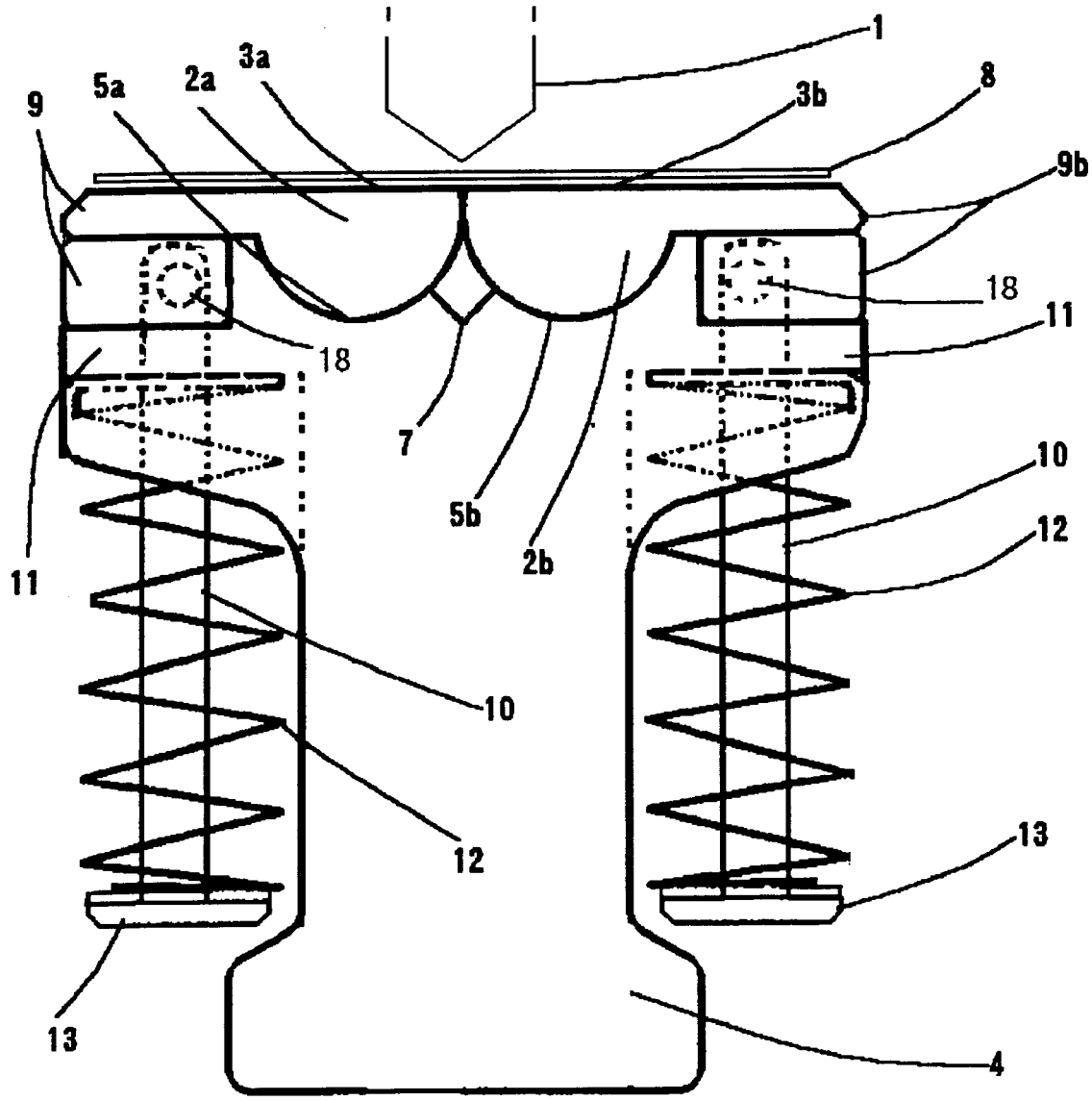
FIG. 5 is a view in section of the apparatus provided with rotary control function of the present invention for bending metal plates showing that lower bar molds provided with push springs are placed in such manner as to rotate slidably on the concave surfaces of the support for bending metal plates

Referring to accompanying drawings, one example of the apparatus provided with rotary control function of the present invention for bending metal plates is hereinafter described. The metal mold, as shown in FIG. 5, comprises the upper punch type mold 1 and the lower mold consisting of two (2) lower bar molds 2*a* and 2*b* semicircular in section. These two (2) lower bar molds are loaded on the support 4. A plurality of pull-up rods 10 are attached by way of pins 18 to the rim parts 9*a* and 9*b* of two (2) lower bar molds (reverse convex surfaces 5*a* and 5*b* of the lower bar molds 2*a* and 2*b* are likewise good). Each of pull-up rod 10 is projectively placed on the side of the support 4 in such manner as to slidably move, running through the stopper 11 provided on the support 4. The push spring 12 is set on the projecting part of each pull-up rod for controlling the rotation of lower bar molds 2*a* and 2*b*. Simultaneously, a fixture is attached to the lower end of each pull-up rod 10. The push spring 12 set on each pull-up rod 10 is fixed together with the stopper 11 and the fixture 13, and attached as a set to the side of the support 4.

Figure 6:
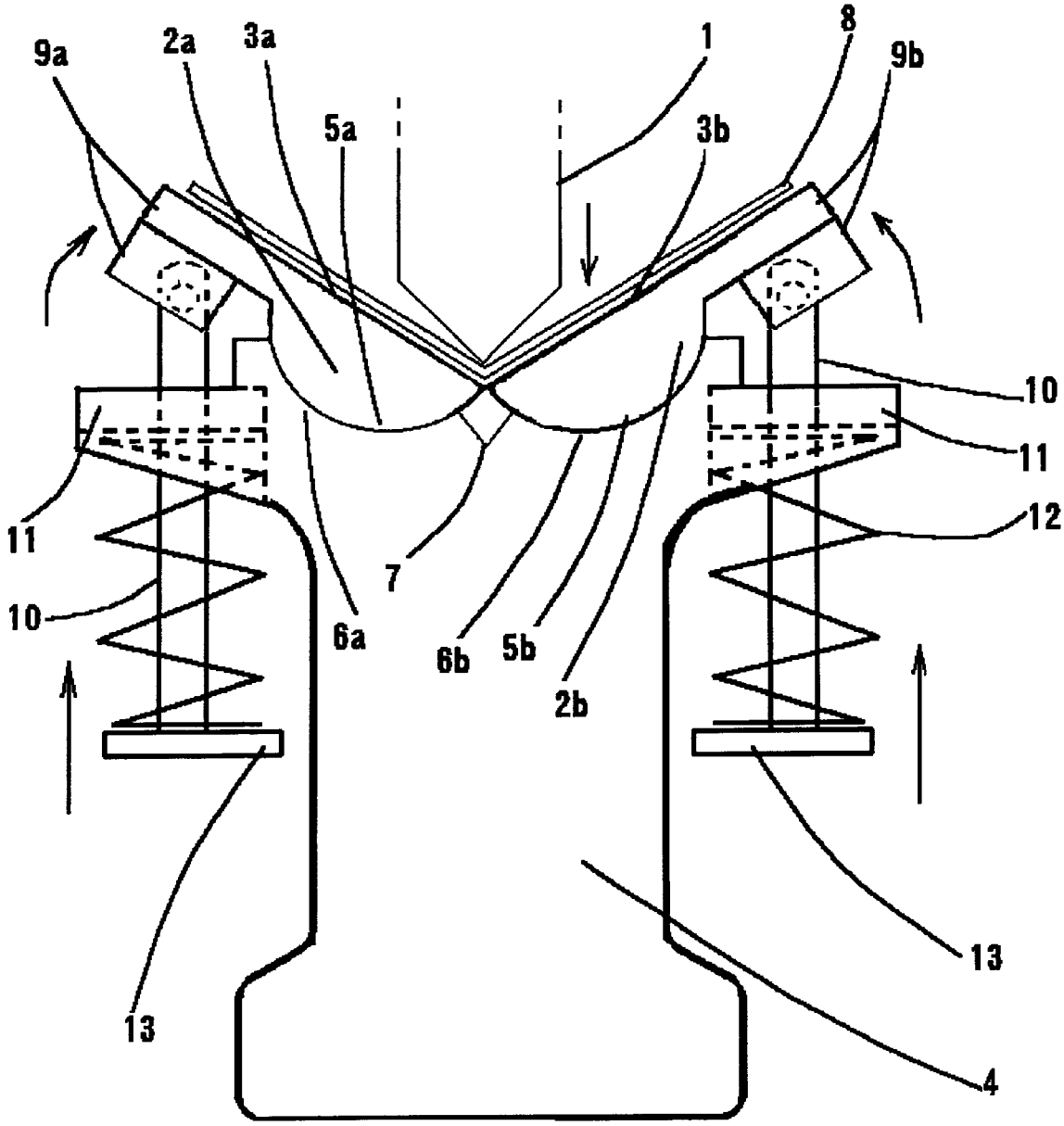
FIG. 6 is a view in section of the apparatus provided with rotary control function of the present invention for bending metal plates showing that the metal contact surfaces are inclined V-shape in section by the slidable rotation of lower bar molds provided with push springs and thereby the metal plate is bent.

Two (2) lower bar molds 2*a* and 2*b* semicircular in section comprises the reverse convex surfaces 5*a* and 5*b* thereunder and metal contact surfaces 2*a* and 2*b* thereon. The reverses convex surfaces 5*a* and 5*b* of two (2) lower bar molds 2*a* and 2*b* are loaded on two (2) concave surfaces 6*a* and 6*b* provided with the groove in the intermediate formed on the support 4. When force is added to the inner end of metal contact surfaces 3*a* and 3*b* on two (2) lower bar molds, the reverses convex surfaces 5*a* and 5*b* on two (2) lower bar molds are caused to rotate slidably inwardly (in the direction of the center),as shown in FIG. 6. Thus, the metal contact surfaces 3*a* and 3*b* are inclined V-shape in section.

For bending the metal plate 8, the metal plate 8 is placed on the metal contact surfaces 3*a* and 3*b* of two (2) lower bar molds. Thereafter, the upper mold 1 is caused to move down by the fixed pressure of the upper mold 1, as shown in FIG. 6. Then, the metal plate is pressed downwardly. The metal contact surfaces 3*a* and 3*b* of two (2) lower bar molds 2*a* and 2*b* are caused to slidably rotate inwardly V-shape in section, and thus the metal plate 8 starts to bend. The rim parts 9*a* and 9*b* of two (2) lower bar molds 2*a* and 2*b* are raised. Simultaneously, each pull-up rod 10 is likewise raised. Thereby, there is raised the fixture 13 attached to the lower end of each pull-up rod 10. The push spring set on the projecting part of each pull-up rod is compressed against the resilience thereof toward the stopper provided on the support.

That is to say, resistance is generated when the push spring 12 having resilience of 1~500 kg/cm$^2$, and preferably 8~180 kg/cm$^2$ is compressed. This resistance works as control against the rotation of the metal contact surfaces 3*a* and 3*b* on the lower bar molds 2*a* and 2*b*. Thus, the metal contact surfaces 3*a* and 3*b* on the lower bar molds 2*a* and 2*b* does not run off the metal plate 8. The pressure of the upper mold 1 is properly conveyed to the metal plate 8. The metal plate 8 is properly attached by pressure to the metal contact surfaces 3*a* and 3*b* of the rotary lower bar molds 2*a* and 2*b* and bent in V-shape.

Then, in the aforementioned state, the stroke of the upper mold 1 is caused to descend up to the position of the fixed bending angle. When there is caused the metal contact surfaces 3*a* and 3*b* on the lower bar molds 2*a* and 2*b* to be inclined up to the bending angle of 90° in V-shape, the metal plate is likewise neatly bent up to the bending angle of 90°. At this time, the downward pressure of the upper mold 1 is accepted and dispersed at the entire metal contact surfaces 3*a* and 3*b* of the two (2) lower bard molds thereunder. Because of this, there are caused no scratches on the metal plate 8 by the friction between the metal plate 8 and the lower bar molds 2*a* and 2*b*. The resultant product made of such metal plate is provided with good outer appearance.

When the metal plate 8 is bent up to the desired bending angle as mentioned above, the downward movement of the upper mold 1 is caused to stop. When the upper mold 1 is lifted up and the downward pressure is released, the fixture 13 attached to the lower end of the pull-up rod 10 is caused to move down by the resilience of each compressed push spring. Simultaneously, the pull-up rod is pushed down. Thereby, the rim parts 9*a* and 9*b* of the lower bard molds 2*a* and 2*b* are pressed down. Simultaneously, the reverse convex surfaces 5*a* and 5*b* on the two (2) lower bard molds 2*a* and 2*b* are caused to rotate slidably in an external direction (side direction) and the metal contact surfaces 3*a* and 3*b* of lower bar molds 2*a* and 2*b* are caused to return automatically to the horizontal position. Thereafter, the bent metal plate 8 is taken out from the bottom. Thereafter, the same operation may be repeated, whenever necessary.

For bending the metal plate 8, the metal contact surfaces 3*a* and 3*b* of lower bar molds 2*a* and 2*b* are not caused to move down up to the bending angle of 90° so as to be inclined in V-shape (lower dead point), and the stroke may be suspended halfway. Thus, the bending angle of the metal 8 may be allowed to be made obtuse or more than 90°. When the stroke of the upper mold 1 is shallow, the metal contact surfaces 3*a* and 3*b* of lower bar molds 2*a* and 2*b* are less inclined and the bending angle of the metal plate 8 becomes obtuse. There is no doubt that the bending degree of the metal plate 8 may be, whenever necessary, adjusted by the stroke of the upper mold 1.

The lower bar molds 2*a* and 2*b* are made in semicircular in section. In addition to those semicircular in section, the round bar may be lengthwise cut off in about ⅓ in section. The round bar may be also lengthwise cut off in about ⅔ section. These are included in the concept of "semicircular section" of the present invention.

The push spring 11 provided on the lower bar molds 2*a* and 2*b* may be attached to the rim parts 9*a* and 9*b* of the lower bar molds 2*a* and 2*b*. When the lower bar molds 2*a* and 2*b* are not provided with the rim parts 9*a* and 9*b*, the push spring may be directly attached to the groove provided on the lower external part of the convex surfaces 5*a* and 5*b* on the lower bar molds 2*a* and 2*b*.

Any ordinary spring may be used as the push spring 11. The resilience of the push spring 11 may be optionally determined by the thickness and quality, etc. of the metal plate to be bent. In normal case, it may be good, if in the range of 1~500 kg/cm$^2$ and, preferably 8~180 kg/cm$^2$.

If the resilience of the push spring 11 is less than 1 kg/cm$^2$, the resistance generated when the push spring is compressed by the pressure of the upper mold 1 is too weak. It does not work satisfactorily as a control against the rotation of the metal contact surfaces 3*a* and 3*b* of lower bar molds 2 and 2*b*. The metal contact surfaces 3*a* and 3*b* of lower bar molds 2 and 2*b* tend to run off the metal plate 8. The pressure of the upper mold 1 is not properly given to the metal plate 8.

Further, if the resilience of the push spring 11 is in excess of 500 kg/cm$^2$, the metal contact surfaces 3*a* and 3*b* of lower bar molds 2 and 2*b* do not run off the metal plate 8. The pressure of the upper mold 1 may be sufficiently given to the metal plate 8. But when the push spring 12 is compressed by the upper mold 1, the resistance generated becomes stronger than necessary. Thus, excessive push force is required from the upper mold 1, resulting in energy loss.

Reference is made to the material for lower bar molds 2*a* and 2*b*, and rim parts 9*a* and 9*b*. Any materials provided with higher hardness and abrasion resistance may be preferably used, such as metal mold steel, bearing steel, chrome-molybdenum steel, etc. Ordinary steel and surface-hardened steel may also be used.

The length and thickness of lower bar molds 2*a* and 2*b*, and rim parts 9*a* and 9*b* may be optionally determined by the thickness and quality of the metal plate 8 to be bent and the desired bending angle of the metal plate 8, etc. In an ordinary case, the lower bar molds 2*a* and 2*b* would be sufficient, if 1~500 cm in length and if 0.5~300 cm in diameter respectively. The metal contact surfaces 3*a* and 3*b* of the lower bar molds 2*a* and 2*b* would be sufficient, if 1×5 cm~300×500 cm in size.

Now referring to the material for the support 4, there may be used the same material as that for lower bar molds 2*a* and 2*b*. The size of the support 4 would be satisfied if it is made larger than two (2) lower bar molds 2*a* and 2*b*.

Further, the size of two (2) concave surfaces 6*a* and 6*b* of the support 4 should be made slightly larger than the reverse convex surfaces 5*a* and 5*b* of two (2) lower bar molds 2*a* and 2*b*. The reverse convex surfaces 5*a* and 5*b* of the lower bar molds 2*a* and 2*b* are formed so as to slidably rotate within the concave surfaces 6*a* and 6*b* of the support 4.

The bending degree of the metal plate 8 may be adjusted by the positions of the metal contact surfaces 3*a* and 3*b* of two (2) lower bar molds 2*a* and 2*b*. For example, the metal contact surfaces 3*a* and 3*b* of the two (2) lower bar molds are those cut off horizontally in the lengthwise direction in about ⅓ section of the round bar. In this case, the metal contact surfaces 3*a* and 3*b* are above positioned in semicircular section. The metal contact surfaces 3*a* and 3*b* of two (2) lower bar molds 2*a* and 2*b* become smaller in their contact area by the slidale rotation of two lower bar molds 2*a* and 2*b*.

In addition, the metal contact surfaces 3*a* and 3*b* of two lower bar molds 2*a* and 2*b* are those cut off horizontally lengthwise in about ⅔ section of the round bar. In this case, the metal contact surfaces 3*a* and 3*b* are below positioned in semicircular section. The metal contact surfaces 3*a* and 3*b* of two (2) lower bar molds 2*a* and 2*b* become larger in their contact area by the slidable rotation of two lower bar molds 2*a* and 2*b*.

The length and thickness of lower bar molds 2*a* and 2*b* and rim parts 9*a* and 9*b* may be optionally determined by the thickness and quality of the metal plate 8 to be bent, the bending angle of the metal plate 8, etc. In normal case, the lower bar molds 2*a* and 2*b* may be satisfied, if in the range of 1~500 cm in length, and in the range of 0.5~300 cm in thickness. Further, the metal contact surfaces 3*a* and 3*b* of the lower bar molds 2*a* and 2*b* may be satisfied, if in the range of 1×5 cm~300×500 cm in size.

Figure 7:
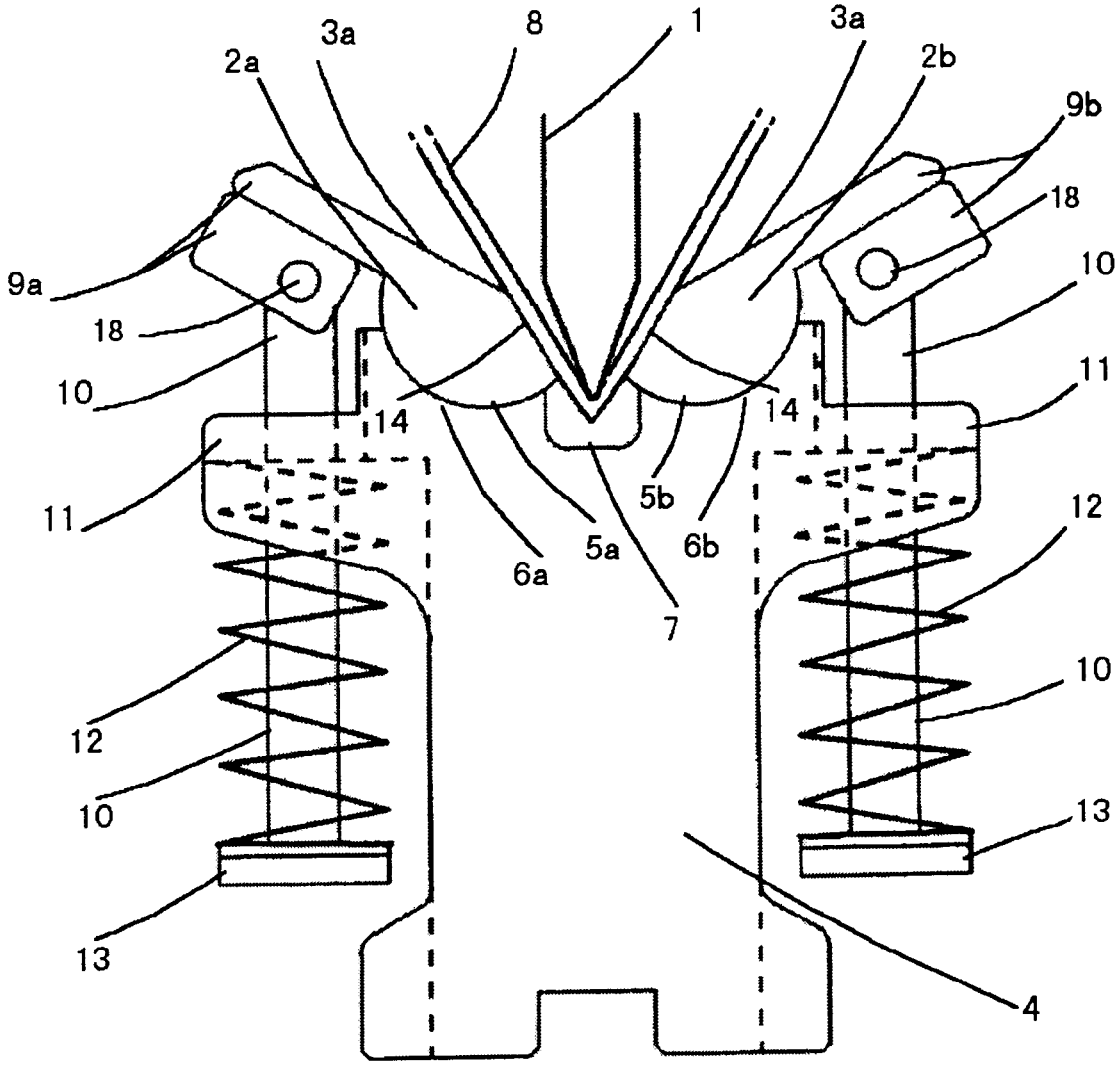
FIG. 7 is an explanatory drawing of the apparatus provided with rotary control function of the present invention for bending metal plates showing that the metal plate is bent at an acute angle of less than 90° by causing the lower bar molds to form lengthwise an acute angle of V-shape in section and be provided with push springs.

Further, when bending the metal plate 8 by pressing the metal plate 8 on the metal contact surfaces 3*a* and 3*b* by the upper mold 1 for bending the metal plate 8 at an acute angle of less than 90°, the adjacent parts in section between the metal contact surfaces 3*a* and 3*b* of two (2) lower bar molds may be preferably formed at the acute angle of V-shape as shown in FIG. 7.

That is to say, the metal plate 8 is placed on the metal contact surfaces 3*a* and 3*b* of the lower bar molds 2*a* and 2*b*. Thereafter, the upper mold 1 is caused to move down and thereby the metal plate 8 is downwardly pressed. By rotating slidably inwardly in V-shape the metal contact surfaces 3*a* and 3*b* of the lower bar molds 2*a* and 2*b* and the acutely bent surfaces 14*a* and 14*b*, the metal plate 8 is caused to start to bend. As shown in FIG. 7, rim parts 9*a* and 9*b* of two (2) lower bar molds are raised and simultaneously each pull-up rod is lifted. Thereby, the fixture 13 attached to the lower end of each pull-up rod is likewise raised. The push spring 12 set on the projected part of each pull-up rod 10 is compressed against the resilience thereof toward the stopper 10 provided on the support 4.

The resistance generated when the push spring 12 is compressed works as the control against the rotation of the metal contact surfaces 3*a* and 3*b* of the lower bar molds 2*a* and 2*b* and the acutely bent surfaces 14*a* and 14*b*. Thus, the metal plate 8 does not run off the metal contact surfaces 3*a* and 3*b* and the acutely bent surfaces 14*a* and 14*b* and the downward pressure of the upper mold 1 is properly transferred to the metal plate 8. By pressing properly the metal plate 8 to the metal contact surfaces 3*a* and 3*b* and the acutely bent surfaces 14*a* and 14*b*, the plate mate 8 is bent in V-shape. The bending angle of the metal plate 8 is reduced to about 90°. This is the first stage bend.

Further, the metal plate is downwardly pressed by the downward movement of the upper mold 1, the metal contact surfaces 3*a* and 3*b* of the lower bar molds 2*a* and 2*b* and the acutely bent surfaces 14*a* and 14*b* are further caused to rotate slidably inwardly for bending the metal plate 8. The rim parts 9*a* and 9*b* of lower bar molds 2*a* and 2*b* and each pull-up rod 10 are further raised and the fixture 13 is further raised. Each spring 12 is further compressed toward the stopper 11 against the resilience thereof.

At this time, the push spring 12 is further compressed, and resistance is generated. This resistance works further as the control against the rotation of the lower bar molds 2*a* and 2*b* and the acutely bent surfaces 14*a* and 14*b*. The metal plate 8 do not run off the lower bar molds 2*a* and 2*b* and the acutely bent surfaces 14*a* and 14*b*. The downward pressure of the upper mold 1 is properly given to the metal plate 8, by properly pressing the metal plate 8 on the acutely bent surfaces 14*a* and 14*b*, the metal plate 8 is bent in V-shape. Thus, the metal plate 8 is bent at an acute angle of less than 90°, for example, 60°. The is the bend at the second stage.

A plurality of pull-up rods 10 are attached to the lower bar molds 2*a* and 2*b* and rim parts 9*a* and 9*b*, as mentioned above. In addition, a plurality of pull-up rods 10 may be attached to the reverses convex surfaces 5*a* and 5*b* of the lower bar molds 2*a* and 2*b*. Further, in stead of the fixture 13 attached to the lower end of each pull-up rod 10, the adjust screw 16 may be slidably fixed, so as to move vertically through the washer 15, to the lower end of each pull-up rod 10. Then, according as the bending condition of the metal plate 8, the position of the adjust screw 16 may be moved for adjusting the rotary control of the lower bar molds 2*a* and 2*b* by the resilience of the push spring 12.

Figure 8:
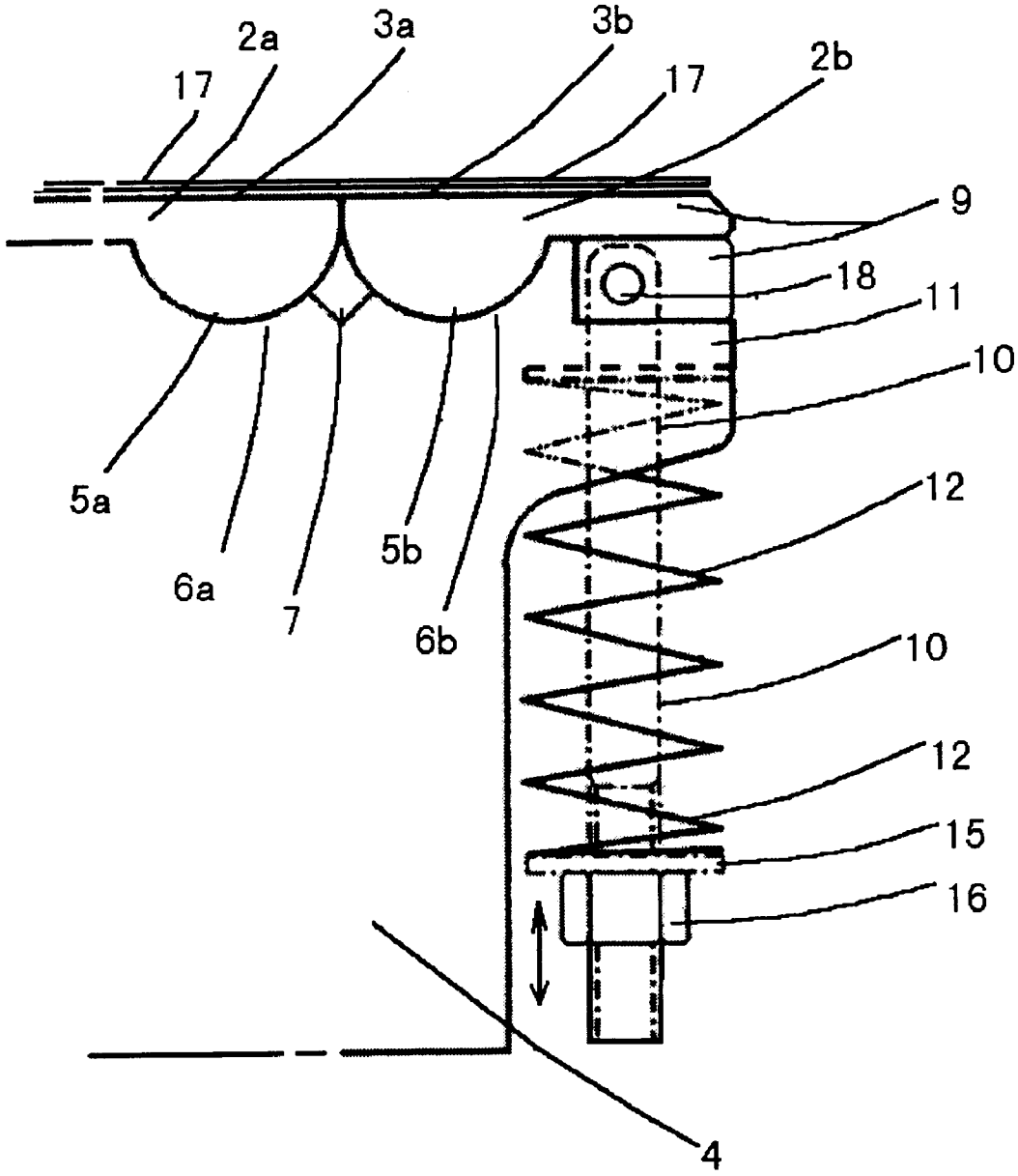
FIG. 8 is an explanatory drawing of the apparatus provided with rotary control function of the present invention for bending metal plates showing that the metal contact surfaces of the lower bar molds are coated with urethane sheet and the adjust screw is slidably placed in such manner as to rotate vertically through the washer.
Figure 9:
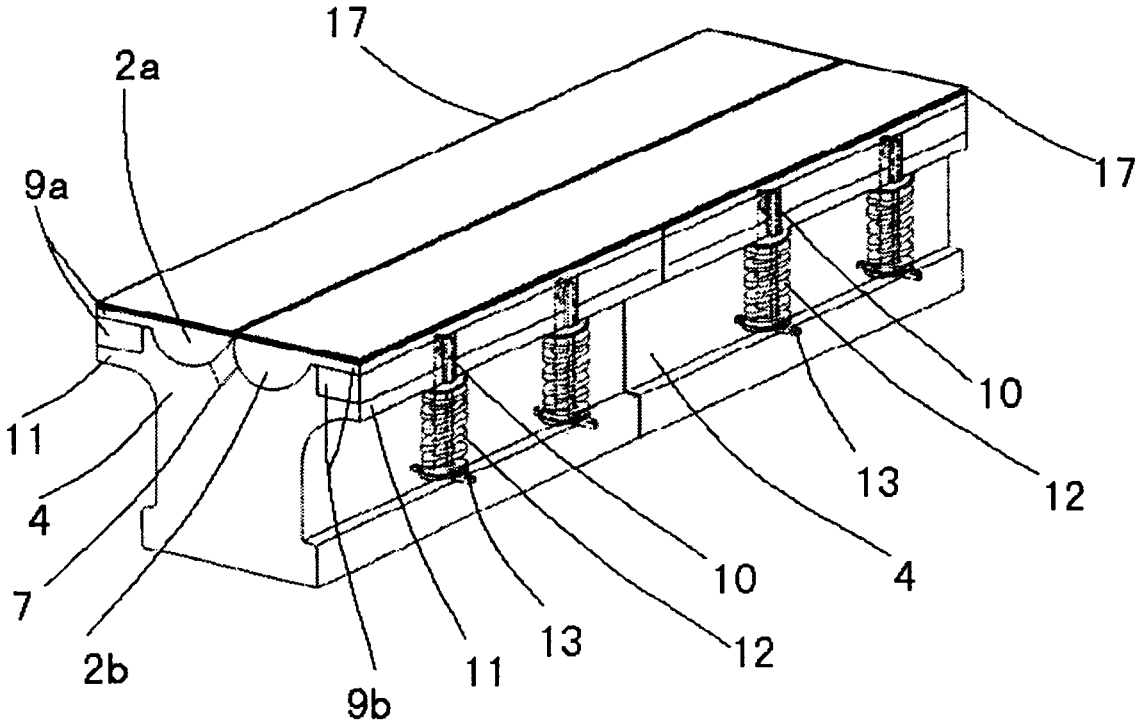
FIG. 9 is an explanatory drawing of the apparatus provided with rotary control function of the present invention for bending metal plates showing that two (2) units of the lower bar molds the metal contact surfaces of which are coated with urethane sheet are caused to coexist lengthwise in a row for bending the lengthy metal plate.

In addition, when bending the metal plate 8 by pressing the metal plate 8 by the upper mold 1 on the metal contact surfaces 3*a* and 3*b* of the lower bar molds 2*a* and 2*b*, scratches, slit scars, etc. may be caused on the lower surface of the metal plate 8 due to the contact of the metal contact surfaces 3*a* and 3*b* of the lower bar molds 2*a* and 2*b* with the lower surfaces of the metal plate 8. In such case, the metal contact surfaces 3*a* and 3*b* of the lower bar molds 2*a* and 2*b* may be coated with urethane sheet 17 as cushion material, as shown in FIGS. 8 and 9. Thus, the formation of scratches, slit scars, etc. may be prevented on the lower surface of the metal plate 8 which is the product of the present invention. In addition to urethane sheet 17, it may be coated with such cushion material as vinyl, cloth, etc.

For preventing the formation of scratches, slit scars, etc. on the lower surface of the metal plate 8, caused by contact with the metal contact surfaces 3*a* and 3*b* of the lower bar molds 2*a* and 2*b*, there may be formed such sliding surface made of hard chromium plating, non-electrolysis nickel plating, etc., in stead of the aforementioned cushion material, on the metal contact surfaces 3*a* and 3*b* of the lower bar molds 2*a* and 2*b*. Or there may be formed such hardened surface as hardening surface, hard heat treatment surface, etc. on the metal contact surfaces 3*a* and 3*b* of the lower bar molds 2*a* and 2*b*. Thus, there may be made slidable between the lower surface of the metal plate 8 and the metal contact surfaces 3*a* and 3*b* of the lower bar molds 2*a* and 2*b* for preventing the formation of scratches, slit scars, etc. on the lower surface of the metal plate 8.

In stead of the aforementioned cushion material surface and sliding surface, there may be formed the sintered carbide surface through electric discharge machning by electric pressure applied between the metal contact surface and an electrode comprising tungsten carbide cobalt or titanium carbide, etc. on the metal contact surfaces 3*a* and 3*b* of the lower bar molds 2*a* and 2*b*. Thus, there is made slidable between the lower surface of the metal plate 8 and the metal contact surfaces 3*a* and 3*b* of the lower bar molds 2*a* and 2*b* for preventing the formation of scratches, slit scars, etc. on the lower surface of the metal plate 8.

For bending the lengthy metal plate 8 by pressing the same plate on the metal contact surfaces 3*a* and 3*b* of the lower bar molds 2*a* and 2*b*, when one set of the metal contact surfaces 3*a* and 3*b* of the lower bar molds 2*a* and 2*b* is too short in length, the support 4 on which the lower bar molds 2*a* and 2*b* is made one unit and then a plurality of such units are caused to coexist lengthwise in one row as shown in FIG. 9. Thereby, the lengthy metal plate may be bent.

Figure 10:
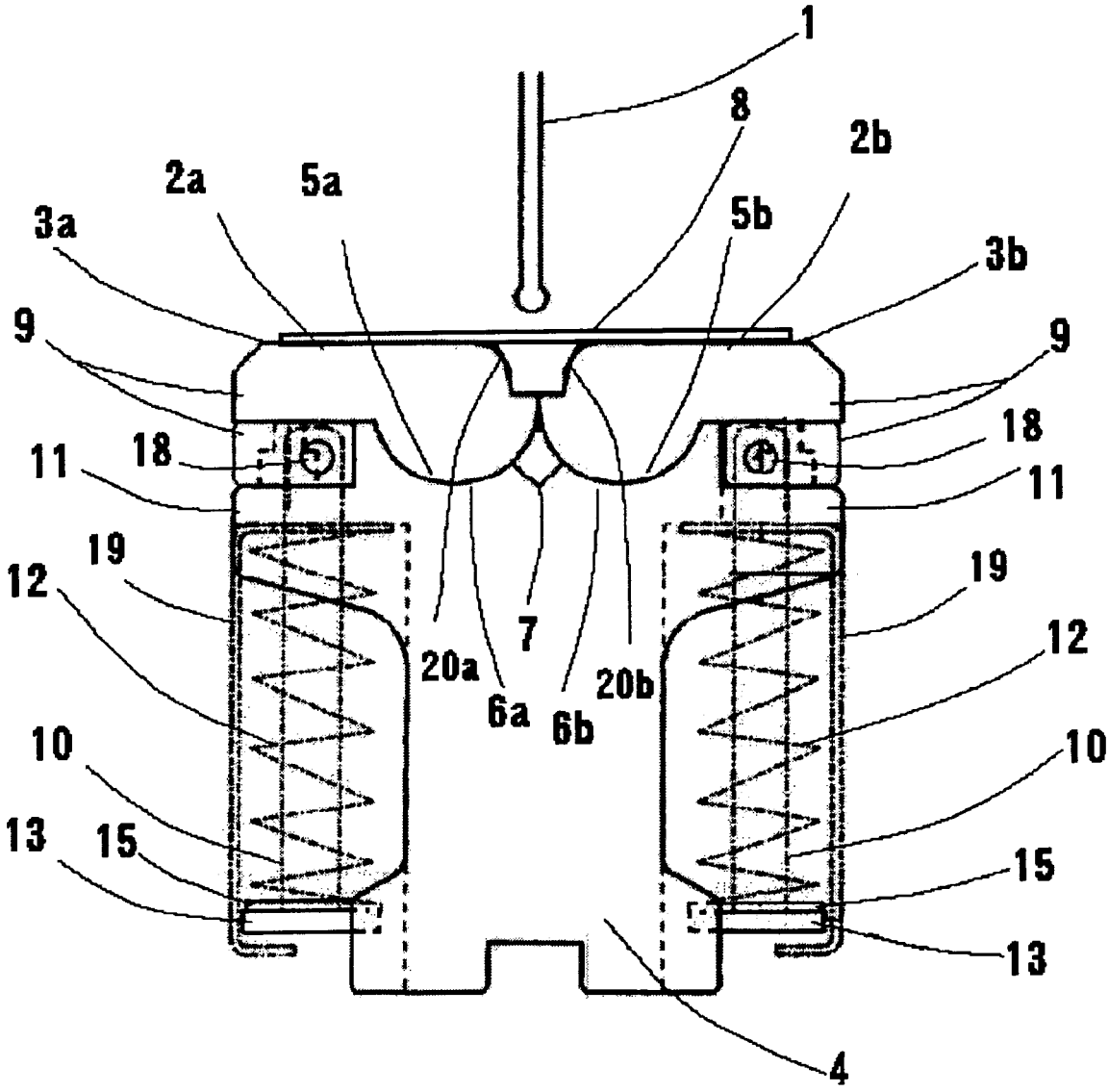
FIG. 10 is a view in section of the apparatus provided with rotary control function of the present invention for bending metal plates in U-shape showing that odd press parts are formed on the metal contact surfaces of the lower bar molds provided with push springs and are loaded on the support for bending the metal plate.

Next, there is hereinafter described one example of the other embodiment of the present invention which is the apparatus provided with rotary control function for bending the metal plate in U-shape. The metal mold comprises the punch type tip-rounded upper mold 1 and two (2) lower bar mold semicircular in section, as shown in FIG. 10. There are formed odd press parts 19*a* and 19*b* by cutting off lengthwise the adjacent parts, L-shape in section, between the metal contact surfaces 3*a* and 3*b* of the lower bar molds 2*a* and 2*b* semicircular in section. These two (2) lower bar molds are loaded on the support 4, as mentioned below.

A plurality of pull-up rods are attached by way of the pin 18 to the rim parts 9*a* and 9*b* of two (2) lower bar molds (the reverse convex 5*a* and 5*b* of lower bar molds 2*a* and 2*b* may be also good). Each pull-up rod is projectively placed, so as to move slidably, on the side of the support 4, running through the stopper 11 provided on the support 4. The push spring 12 for controlling the rotation of lower bar molds 2*a* and 2*b* is set on the projective part of each pull-up rod. Simultaneously, the fixture 13 is attached to the lower end of each pull-up rod. The push spring 12 set on each pull-up rod 10 is fixed together with the stopper 11 and the fixture 13, and, as such, attached to the side of the support 4.

Two (2) lower bard molds semicircular in section are provided with the reverse convex surfaces 5*a* and 5 thereunder and the metal contact surfaces 3*a* and 3*b* thereon. The reverse convex surfaces 5*a* and 5*b* of these two (2) lower bar mold 2*a* and 2*b* are loaded on the two (2) concave surfaces 6*a* and 6*b*, provided on the support 4, having the groove 7 in the intermediate thereof. A force is added to odd press parts 19*a* and 19*b* of two (2) bar molds 2*a* and 2*b*, the reverse convex surfaces 5*a* and 5*b* of two (2) lower bar molds 2*a* and 2*b* are caused to rotate inwardly (toward the center). Then, odd press parts 19*a* and 19*b* are caused to rotate inwardly.

Figure 11:
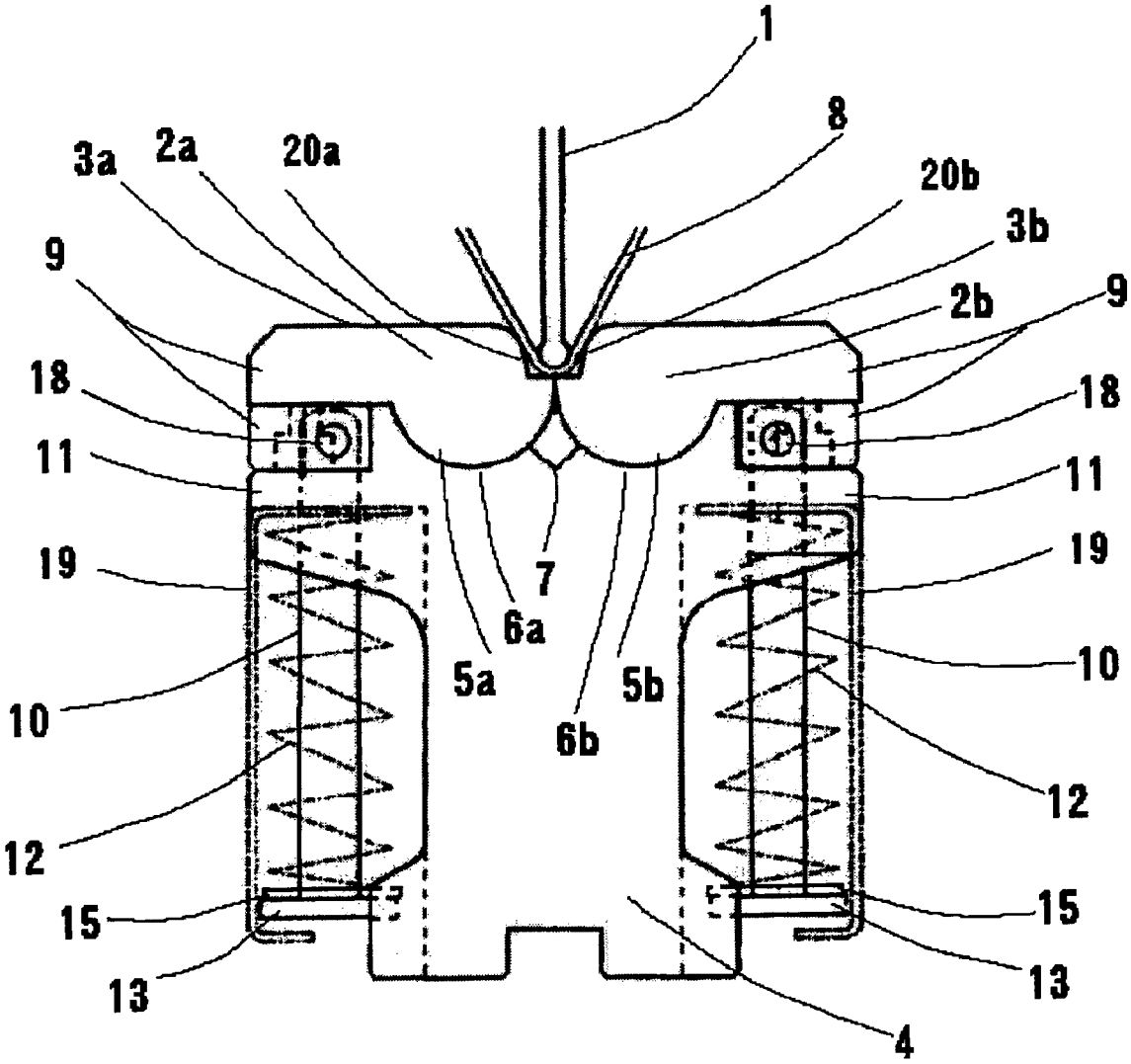
FIG. 11 is a view in section of the apparatus provided with rotary control function of the present invention for bending metal plates in U-shape showing that odd press parts are formed on the metal contact surfaces of the lower bar molds provided with push springs and are loaded on the support for bending the metal plate of the first stage in V-shape.

For bending the metal plate 8 in U-shape, the metal plate 8 is placed on the metal contact surfaces 3*a* and 3*b* of the lower bar molds 2*a* and 2*b*, as shown in FIG. 10. Thereafter, the tip-rounded upper mold 1 is caused to move downwardly by the fixed pressure, as shown in FIG. 11. Thereby, the metal plate 8 is downwardly pressed and subjected to the first stage bend in U-shape. At this stage, the fixed pressure of the upper mold 1 is weaker than the resilience of the push spring 12 of the lower bar molds 2*a* and 2*b*. Therefore, the metal contact surfaces 3*a* and 3*b* of the lower bar molds 2*a* and 2*b* and odd press parts 19*a* and 19*b* are not caused to rotate inwardly. The rim parts 9*a* and 9*b* of two (2) lower bar molds are not raised. Each pull-up rod is not likewise raised.

That is to say, when an attempt is made for compressing the push spring 12 by the tip-rounded upper mold 1, the resistance of the push spring 12 generated thereby works against the rotation of the metal contact surfaces 3*a* and 3*b* of the lower bar molds 2*a* and 2*b* and odd press parts 20*a* and 20*b*. The metal contact surfaces 3*a* and 3*b* of the lower bar molds 2*a* and 2*b* and odd press parts 20*a* and 20*b* neither rotate nor run off the metal plate 8. The pressure of the upper mold 1 is properly given to the metal plate 8. The metal plate 8 is properly pressed to the odd press parts 20*a* and 20*b* of lower rotary bar molds 2*a* and 2*b* semicircular in section, and is bent in U-shape. This is the first stage bend.

Figure 12:
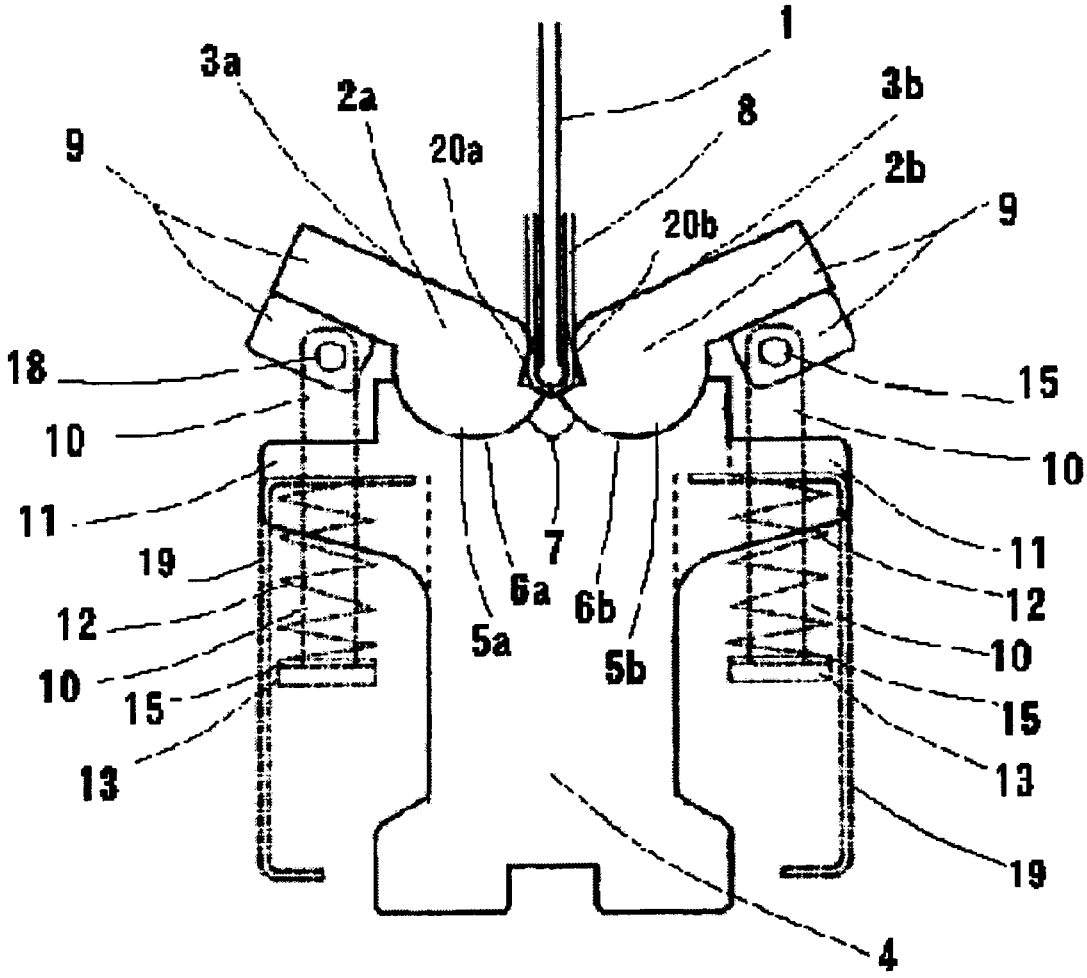
FIG. 12 is a view in section of the apparatus provided with rotary control function of the present invention for bending metal plates in U-shape showing that odd press parts are formed on the metal contact surfaces of the lower bar molds provided with push springs and loaded on the support for the second stage bend of the metal plate in U-shape.

Then, the stroke position of the aforementioned upper mold 1 is further lowered by the pressure stronger than the pressure of the aforementioned upper mold 1. The odd press parts 20*a* and 20*b* of lower bar molds 2*a* and 2*b* are caused to slidably rotate inwardly and the metal plate 8 is bent in U-shape. This is the second stage bend. At this time, the metal plate 8 is further bent by the odd press parts 20*a* and 20*b* of lower bar molds 2*a* and 2*b* as shown FIG. 12. The rim parts 9*a* and 9*b* of lower bar molds 2*a* and 2*b* and each pull-up rod are still further raised and thereby the fixture 13 is still further raised. Each spring 12 is still further compressed toward the stopper 11 against the resilience thereof.

The resistance generated at this time works as a control against the rotation of odd press parts 20*a* and 20*b*. The odd press parts 20*a* and 20*b* do not run off the metal plate 8 and are caused to rotate inwardly. The pressure of the upper mold 1 is properly given to the metal plate 8. The metal plate 8 is properly pressed to the odd press parts 20*a* and 20*b* and bent in U-shape. This is the second stage bend. The metal plate 8 is neatly bent in U-shape and no scratches are formed on the metal plate 8. The product made of metal plates bent has a good outer appearance, When the metal plate 8 is bent in U-shape as mentioned above, the downward movement of the upper mold 1 is caused to stop. The upper mold 1 is lifted up and the pressure thereof is released. The fixture 13 attached to the lower end of each pull-up rod 10 is pressed down by the resilience of each push spring 11 compressed and simultaneously the pull-up rod 10 is pressed down. Thereby, the rim parts 9*a* and 9*b* of two (2) lower bar molds are pressed down and the reverse convex surfaces 5*a* and 5*b* of two (2) lower bar molds are caused to rotate slidably toward the outside (in the side direction). Thereby, the metal contact surfaces 3*a* and 3*b* of two (2) lower bar molds are caused to automatically return to the horizontal position. Simultaneously, the odd press parts 20*a* and 20*b* are likewise caused to return to the original position. The metal plate 8 bent in U-shape is taken out of the lower part thereof. Thereafter, the aforementioned operation may be repeated whenever it is necessary.

The lower bar molds 2*a* and 2*b* are made in semicircular in section. In addition to those semicircular in section, the round bar may be lengthwise cut off in about ⅓ in section. the round bar may be lengthwise cut off in about ⅔ section. These are included in the concept of "semicircular section" of the present invention.

The push spring 11 attached to lower bar molds 2*a* and 2*b* may be attached to rim parts 9*a* and 9*b* of lower bar molds 2*a* and 2*b*. But, when there are no rim parts 9*a* and 9*b* in the lower bar molds 2*a* and 2*b*, the push spring may be directly fixed in the groove provided below on the outside surface of convex surfaces 5*a* and 5*b* of lower bar molds 2*a* and 2*b*.

Any ordinary spring may be used as the push spring 11. The resilience of the push spring 11 may be optionally determined by the thickness and quality of the metal plate 8 to be bent in U-shape. In normal case, the push spring 11 may be satisfied, if normally in the range of 1~500 kg/cm$^2$, and preferably in the range of 8~180 kg/cm$^2$. This push spring may be protected by the cover 19.

That is to say, the resistance generated, when the push spring 12, in the range of 1~500 kg/cm$^2$ in resilience, and preferably in the range of 8~180 kg/cm$^2$ is compressed, works as control against the rotation of the metal contact surfaces 3*a* and 3*b* of lower bar molds and odd push parts 19*a* and 19. Thus, the metal contact surfaces 3*a* and 3*b* of lower bar molds and odd press parts 19*a* and 19 do not run off the metal plate 8. The pressure of the upper mold 1 is properly given to the metal plate 8. The metal plate 8 is properly pressed on the metal contact surfaces 3*a* and 3*b* of lower rotary bar molds 2*a* and 2*b* and odd push parts 20*a* and 20*b* and bent in U-shape.

If the resilience of the push spring 11 is less than 1 kg/cm$^2$, the resistance generated when the push spring 12 is compressed by the pressure of the tip-rounded upper mold 1 becomes weaker. It does not work sufficiently as control against the metal contact surfaces 3*a* and 3*b* of lower bar molds 2*a* and 2*b* and odd press parts 20*a* and 20*b*. Thus, the metal contact surfaces 3*a* and 3*b* of lower bar molds and odd press parts 20*a* and 20*b* tend to run off the metal plate 8. It becomes harder for the pressure of the upper mold 1 to be properly conveyed to the metal plate 8.

If the resilience of the push spring 11 is in excess of 500 1 kg/cm$^2$, the metal contact surfaces 3*a* and 3*b* of lower bar molds 2*a* and 2*b* and odd push parts 20*a* and 20*b* do not run off the metal plate 8. The pressure of the tip-rounded upper mold 1 may be properly conveyed to the metal plate 8. But the resistance generated when the push spring 12 is compressed by the pressure of the upper mold 1 becomes stronger than necessary. Because of this, an excessive pressure is required from the tip-rounded upper mold 1, resulting in energy loss.

Referring to the materials for the lower bar molds 2*a* and 2*b* and rim parts 9*a* and 9*b* parts, the most suitable materials are metal mold steel, bearing steel, chrome-molybdenum steel, etc. provided with hardness and high abrasion resistance. Ordinary steel and ordinary surface-quenched steel may be also used.

The length and thickness of lower bar molds 2*a* and 2*b* and rim parts 9*a* and 9*b* may be optionally determined by the thickness and quality of the metal plate 8 to be bent in U-shape, the bending angle thereof, etc. In normal case, the lower bar molds 2*a* and 2*b* may be satisfied, if in the range of 1~500 cm in length, and in the range of 0.5~300 cm in thickness. The metal contact surfaces 3*a* and 3*b* of the lower bar molds 2*a* and 2*b* may be satisfied, if in the range of 1×5 cm~300×500 cm in size.

Referring to the material for the support 4, there is satisfied the same material as the aforementioned material for the lower bar molds 2*a* and 2*b*. The size of the support 4 is satisfied, if it is made larger than the lower bar molds 2*a* and 2*b*. Further, the size of two (2) concave surfaces 6*a* and 6*b* on the support 4 is made slightly larger than the reverse convex surfaces 5*a* and 5*b* of lower bar molds 2*a* and 2*b*. The reverse convex surfaces 5*a* and 5*b* of lower bar molds 2*a* and 2*b* are formed so as to rotate slidably within the concave surfaces 6*a* and 6*b* of the support 4.

The length and thickness of lower bar molds 2*a* and 2*b* and rim parts 9*a* and 9*b* may be optionally determined by the thickness and quality of the metal plate 8 to be bent in U-shape, the bending angle thereof, etc. In normal case, the lower bar molds 2*a* and 2*b* may be sufficiently satisfied, if in the range of 1~500 cm in length, and in the range of 0.5~300 cm in thickness. Further, the metal contact surfaces 3*a* and 3*b* of the lower bar molds 2*a* and 2*b* may be satisfied, if in the range of 1×5 cm~300×500 cm in size.

Further, the odd press parts 20*a* and 20*b* of lower bar molds 2*a* and 2*b* semicircular in section is formed by cutting off lengthwise the adjacent odd parts between the metal contact surfaces 3*a* and 3*b* of the lower bar molds 2*a* and 2*b* in L-shape. The odd press parts 19*a* and 19*b* are satisfied, if made 0.25~50 cm in depth, and if made 0.5~100 cm in width.

Figure 13:
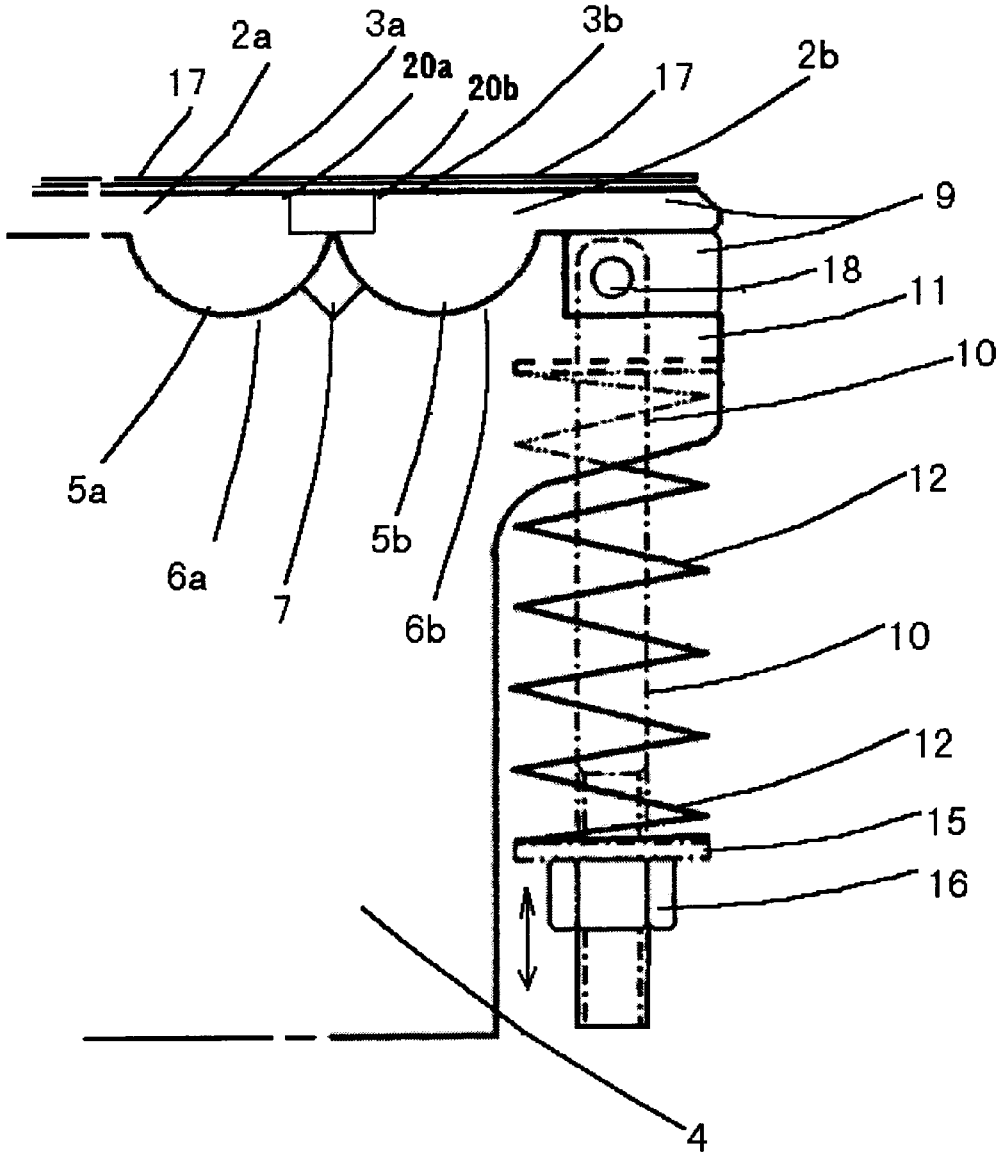
FIG. 13 is an explanatory drawing of the apparatus provided with rotary control function of the present invention for bending metal plates in U-shape showing that adjust screw is attached to the lower end of the pull-up rod attached to the rim of the lower bar mold in such manner as to slidably rotate vertically through the washer.
Figure 14:
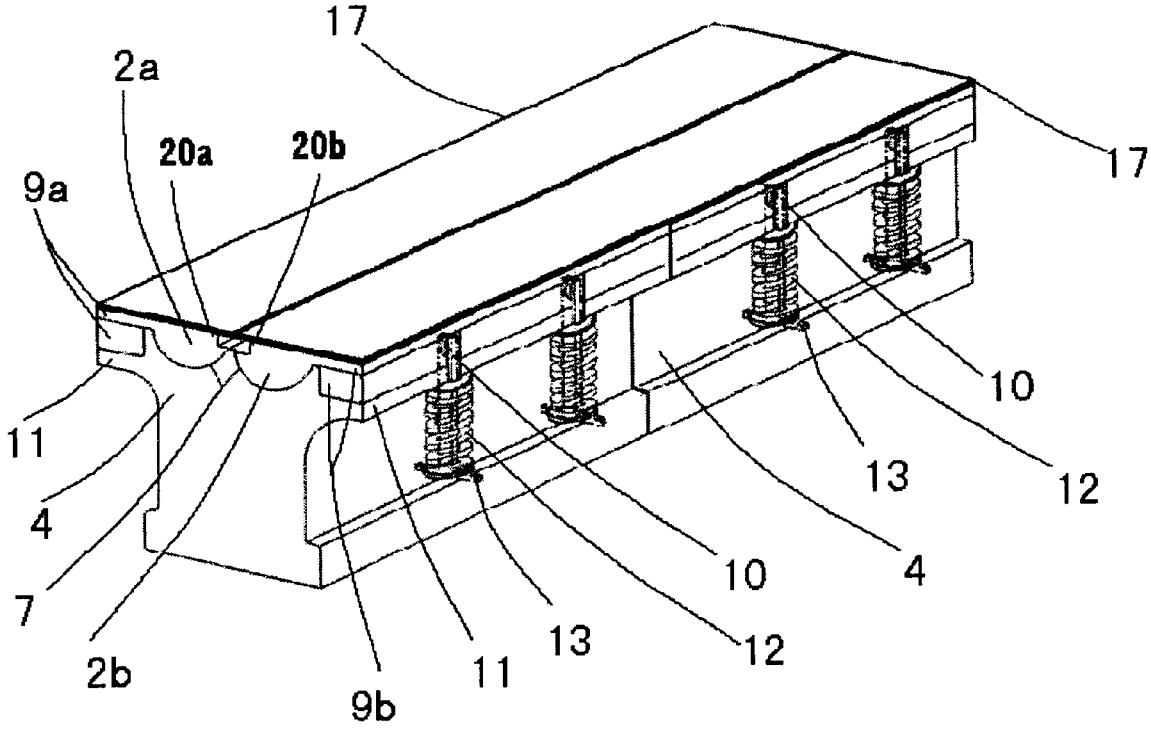
FIG. 14 is an explanatory drawing of the apparatus provided with rotary control function of the present invention for bending metal plates in U-shape showing that the metal contact surfaces of the lower bar molds are coated with urethane.

A plurality of pull-up rods 10 may be attached, as mentioned above, to the lower bar mold 2*a* and 2*b* and rim parts 9*a* and 9*b*. In addition thereto, they may be also attached to the reverse convex surfaces 5*a* and 5*b* of lower bar molds 2*a* and 2*b*. Further, in stead of the fixture 13 attached to the lower end of each pull-up rod 10, the adjust screw 16 may be slidably attached, so as to move vertically through the washer 15, to the lower end of each pull-up rod 10 as shown in FIG. 13. Depending upon the condition for bending the metal plate 8 in U-shape, the position of the adjust screw 16 may be moved for adjusting the rotary control of the lower bar mold 2*a* and 2*b* by the resilience of the push spring 12.

Further, when bending the metal plate 8 in U-shape by pressing the metal plate 8 on the lower bar molds 2*a* and 2*b* by the tip-rounded upper mold 1, the lower surface of the metal plate 8 comes into contact with the metal contact surfaces 3*a* and 3*b* of the lower bar mold 2*a* and 2*b*, and there may be sometimes caused scratches, slit scars, etc. on the lower surface of the metal plate 8. In such case, the metal contact surfaces 3*a* and 3*b* of two (2) lower bar molds 2*a* and 2*b* may be coated with urethane sheet 17 as cushion material. Or, if necessary, the odd press parts 20*a* and 20*b* may be coated with urethane sheet 17 as cushion material. It is advisable to prevent scratches, slit scars, etc. thereby from being formed on the lower surface of the metal plate 8 which is the product for sale. In addition to urethane sheet 17, the product may be coated with vinyl, cloth, etc.

For preventing the formation of scratches, slit scars, etc. on the lower surface of the metal plate 8 by contact with the metal contact surfaces 3*a* and 3*b* (or the odd press parts 19*a* and 19*b*) of the lower bar molds 2*a* and 2*b*, there may be formed such sliding surface as hard chromium plating, non-electrolysis nickel plating, etc., in stead of the aforementioned cushion material, on the metal contact surfaces 3*a* and 3*b* of the lower bar molds 2*a* and 2*b*. Or there may be formed such hardened surface as hardening surface, hard heat treatment surface, etc. on the metal contact surfaces 3*a* and 3*b* (or odd press parts 20*a* and 20*b*) of the lower bar molds 2*a* and 2*b*. Thus, there may be made slidable between the lower surface of the metal plate 8 and the metal contact surfaces 3*a* and 3*b* (or the odd press parts 19*a* and 19*b*) of the lower bar molds 2*a* and 2*b* for preventing the formation of scratches, slit scars, etc. on the lower surface of the metal plate 8.

In stead of the aforementioned cushion material surface and sliding surface, there may be formed, on the metal contact surfaces 3*a* and 3*b* (or the odd press parts 20*a* and 20*b*) of the lower bar molds 2*a* and 2*b*, the sintered carbide surface through electric discharge machining by electric pressure applied between electrodes comprising tungsten carbide cobalt or titanium carbide, etc. and the metal contact surfaces. Thereby, there may be made slidable between the lower surface of the metal plate 8 and the metal contact surfaces 3*a* and 3*b* (or odd press parts 20*a* and 20*b*) of the lower bar molds 2*a* and 2*b* for preventing the formation of scratches, slit scars, etc. on the lower surface of the metal plate 8.

For bending the lengthy metal plate 8 in U-shape by pressing the same plate on the two (2) lower bar molds 2*a* and 2*b*, when one set of the metal contact surfaces 3*a* and 3*b* of the lower bar molds 2*a* and 2*b* is too short in length, the support 34 on which the lower bar molds 2 and 2*b* is made one unit. A plurality of such units are caused to coexist lengthwise in one row as shown in FIG. 9. Thereby, the lengthy metal plate may be bent.

Possible Application in Industry

According to the present invention, it is possible to bend the metal plate neatly and sharply according as the desired bending angle (R) of the metal plate for which it is used, by controlling the rotation of one or a few pairs of lower bar molds provided with the push spring having the rotary control function, pressing the metal plate thereby to the metal contact surfaces of the lower bar molds and conveying the pressure of the upper mold properly to the metal plate. Thus, the bending preciseness of the metal plate is improved. This is one of the excellent advantages of the present invention.

Further, according to the present invention, the acute angle surfaces 14*a* and 14*b* are lengthwise formed V-shape in section on the metal contact surfaces 3*a* and 3*b* of two (2) lower bar molds. Thereby, it is possible to bend the metal plate neatly and sharply at an acute angle of less than 90°. This is one of the advantages of the present invention.

Further, according to the present invention, when the metal plate is bent by the metal mold, the downward pressure of the upper mold conveyed through the metal plate to the groove surface of the lower mold have been reduced by halves. At the same time, that pressure is released by the rotation of the metal contact surfaces of the two (2) lower bar molds. Thus, there are caused no scratches from the friction between the metal plate and the groove surface of the lower mold. Thus, the product made of the metal plate bent thereby has the better outer appearance. This contributes to improvement in the quality of the metal plate as the product. Particularly, when there are formed urethane cushion surface, sliding surface, sintered carbide surface on the metal contact surfaces of lower bar molds, scratches, slit scars, etc. are completely prevented from being formed on the lower surface of the metal plate by the metal contact surfaces of lower bar molds. It is, therefore, most suitable for bending ornamental metal plates or plates with irregularities thereon in U-shape, because they may not be accepted if there are scratches, etc. thereon.

Further, according to the present invention, it is possible to bend the lengthy metal plate by causing a plurality of units loaded on the support provided with two (2) concave surfaces of two (2) lower bar molds to coexist lengthwise in one row. This is one of the advantages of the present invention.

Further, according to the present invention, there is no need for restoring manually the metal contact surfaces of the two (2) lower bar molds to the original position. The metal contact surfaces of the two (2) lower bar molds are automatically caused to return to the horizontal position. Thus, the bending processes of the metal plates are remarkably improved.

Further, according to the present invention, even when the stroke of the upper mold does not reach the lower dead point, it is possible to bend the metal plate. Because of this, the shock by the stroke of the upper mold is mitigated. There is minimized the effect of friction caused between the groove surface of the lower mold and the metal plate by the downward pressure of the upper mold. Thus, scratches and damages are eliminated on the groove surfaces of the lower molds. This prevent the lower mold groove from being abraded and worn out and contributes to the longer life of the metal molds. The work performance of the metal mold is stabilized and may be used semi-permanently. This is one of the advantages of the present invention.

According to the present invention, it is possible to bend the metal plate neatly in U-shape according as the desired bending angle (R) of the metal plate for which it is used, by controlling the rotation of one or a few pairs of lower bar molds provided with the push spring having the rotary control function, pressing the metal plate thereby to the metal contact surfaces of the lower bar molds and conveying the pressure of the tip-rounded upper mold properly to the metal plate. Thus, the bending preciseness of the metal plate is improved. This is one of the excellent advantages of the present invention.

Further, according to the present invention, when the metal plate is bent by the metal mold in U-shape, the downward pressure of the upper mold conveyed through the metal plate to the groove surface of the lower mold has been reduced by halves. At the same time, that pressure is released by the rotation of the metal contact surfaces of the two (2) lower bar molds. Thus, there are little caused scratches from the friction between the metal plate and the groove surface of the lower mold. Thus, the product made of the metal plate bent thereby in U-shape has the better outer appearance. This contributes to the better quality of the metal plate as the product.

Particularly, when there are formed urethane cushion surface, sliding surface, sintered carbide surface on the metal contact surfaces of lower bar molds, scratches, slit scars, etc. are completely prevented from being formed on the lower surface of the metal plate by the metal contact surfaces of lower bar molds. It is, therefore, most suitable for bending ornamental metal plates or plates with irregularities thereon in U-shape, because they may not be accepted, if there are scratches, etc. thereon.

Further, according to the present invention, it is possible to bend the lengthy metal plate in U-shape by causing a plurality of units loaded on the support provided with two (2) concave surfaces of two (2) lower bar molds to coexist lengthwise in one row. This is one of the advantages of the present invention.

Further, according to the present invention, even when the stroke of the tip-rounded upper mold does not reach the lower dead point, it is possible to bend the metal plate in U-shape. Because of this, the shock by the stroke of the upper mold is mitigated. There is minimized the effect of friction caused between the groove surface of the lower mold and the metal plate by the downward pressure of the upper mold. Thus, scratches and damages are eliminated on the groove surfaces of the lower molds. This prevent the lower mold groove from being abraded and worn out and contributes to the longer life of the metal molds. The work performance of the metal mold is stabilized and may be used semi-permanently. This is one of the advantages of the present invention.

What is claimed is:

1. A metal sheet bending apparatus comprising:

a support having first and second concave portions each having a section of a semicircular shape, a groove being formed between the first and second concave portions;

first and second lower bar molds each having a section of a semicircular shape, the first and second lower bar molds having metal contact surfaces, respectively and being rotatably provided in the first and second concave portions, respectively such that the semicircular shape of each of the first and second lower bar molds fits in the semicircular shape of each of the first and second concave portions;

first and second pull-up rods having end portions, respectively, the end portions being rotatably connected to the first and second lower bar molds, respectively;

first and second stoppers provided to the support, the first and second pull-up rods passing through the first and second stoppers, respectively;

first and second adjust screws attached to the first and second pull-up rods, respectively at an opposite side of the end portions with respect to the first and second stoppers;

first push spring provided between the first stopper and the first adjust screw;

second push spring provided between the second stopper and the second adjust screw, spring force given by the first and second push springs being adjusted by the first and second adjust screws; and an upper mold adapted to bend a metal sheet placed on the metal contact surfaces of the first and second lower bar molds by pressing the metal sheet above the groove while the first and second lower bar molds rotate against spring force given by the first and second push springs such that the metal contact surfaces form a V-shape.

2. The metal sheet bending apparatus according to claim 1, wherein the first and second lower bar molds have recessed portions extending along a longitudinal direction of the first and second lower bar molds, the recessed portions forming a V-shaped cross section.

3. The metal sheet bending apparatus according to claim 1, wherein a cushion material surface, a sliding surface, or a sintered carbide surface are formed on the metal contact surfaces.

4. The metal sheet bending apparatus according to claim 1, wherein the cushion material surface comprises urethane, vinyl, or cloth.

5. The metal sheet bending apparatus according to claim 1, wherein the sliding surface includes hard chromium plating, non-electrolysis nickel plating, a hardening surface, or a hard heat treatment surface.

6. The metal sheet bending apparatus according to claim 1, wherein the sintered carbide surface is formed through electric discharge by applying voltage between the metal contact surfaces and an electrode comprising tungsten carbide cobalt or titanium carbide.

7. A metal sheet bending apparatus comprising:

a support having first and second concave portions each having a section of a semicircular shape, a groove being formed between the first and second concave portions;

first and second lower bar molds each having a semicircular shaped section along a surface perpendicular to a longitudinal direction of the first and second lower bar molds, the first and second lower bar molds having metal contact surfaces, respectively and being rotatably provided in the first and second concave portions, respectively such that the semicircular shaped section of each of the first and second lower bar molds fits in the semicircular shape of each of the first and second concave portions, the first and second lower bar molds having recessed portions on the metal contact surfaces along the longitudinal direction at a contact portion between the first and second lower bar molds;

first and second pull-up rods having end portions, respectively, the end portions being rotatably connected to the first and second lower bar molds, respectively;

first and second stoppers provided to the support, the first and second pull-up rods passing through the first and second stoppers, respectively;

first and second fixture attached to the first and second pull-up rods, respectively at an opposite side of the end portions with respect to the first and second stoppers;

first push spring provided between the first stopper and the first fixture;

second push spring provided between the second stopper and the second fixture; and an upper mold having a rounded tip and adapted to bend a metal sheet placed on the metal contact surfaces of the first and second lower bar molds by pressing the rounded tip against the metal sheet above the groove and further to bend the metal sheet to be a U-shape while the first and second lower bar molds rotate against spring force given by the first and second push springs such that the metal contact surfaces form a substantially V-shape.

8. The metal sheet bending apparatus according to claim 7, wherein a cushion material surface, a sliding surface, or a sintered carbide surface are formed on the metal contact surfaces.

9. The metal sheet bending apparatus according to claim 8, wherein the cushion material surface comprises urethane, vinyl, or cloth.

10. The metal sheet bending apparatus according to claim 8, wherein the sliding surface includes hard chromium plating, non-electrolysis nickel plating, a hardening surface, or a hard heat treatment surface.

11. The metal sheet bending apparatus according to claim 8, wherein the sintered carbide surface is formed through electric discharge by applying voltage between the metal contact surfaces and an electrode comprising tungsten carbide cobalt or titanium carbide.

12. A metal sheet bending apparatus comprising:

a support having first and second concave portions each having a section of a semicircular shape, a groove being formed between the first and second concave portions;

first and second lower bar molds each having a semicircular shaped section along a surface perpendicular to a longitudinal direction of the first and second lower bar molds, the first and second lower bar molds having metal contact surfaces, respectively and being rotatably provided in the first and second concave portions, respectively such that the semicircular shaped section of each of the first and second lower bar molds fits in the semicircular shape of each of the first and second concave portions, the first and second lower bar molds having recessed portions on the metal contact surfaces along the longitudinal direction at a contact portion between the first and second lower bar molds;

first and second pull-up rods having end portions, respectively, the end portions being rotatably connected to the first and second lower bar molds, respectively;

first and second stoppers provided to the support, the first and second pull-up rods passing through the first and second stoppers, respectively;

first and second adjust screws attached to the first and second pull-up rods, respectively at an opposite side of the end portions with respect to the first and second stoppers;

first push spring provided between the first stopper and the first adjust screw;

second push spring provided between the second stopper and the second adjust screw, spring force given by the first and second push springs being adjusted by the first and second adjust screws; and an upper mold having a rounded tip and adapted to bend a metal sheet placed on the metal contact surfaces of the first and second lower bar molds by pressing the rounded tip against the metal sheet above the groove and further to bend the metal sheet to be a U-shape while the first and second lower bar molds rotate against spring force given by the first and second push springs such that the metal contact surfaces form a substantially V-shape.

* * * * *

UNITED STATES PATENT AND TRADEMARK OFFICE

CERTIFICATE OF CORRECTION

PATENT NO. : 6,672,127 B2
DATED : January 6, 2004
INVENTOR(S) : Maeda

It is certified that error appears in the above-identified patent and that said Letters Patent is hereby corrected as shown below:

Title page,
Item [12], Title should read:
-- (12) United States Patent
Maeda --

Signed and Sealed this

Fifteenth Day of February, 2005

JON W. DUDAS
*Director of the United States Patent and Trademark Office*

UNITED STATES PATENT AND TRADEMARK OFFICE

CERTIFICATE OF CORRECTION

PATENT NO. : 6,672,127 B2
APPLICATION NO. : 10/049619
DATED : January 6, 2004
INVENTOR(S) : Maeda It is certified that error appears in the above-identified patent and that said Letters Patent is hereby corrected as shown below:

Title page,
Item [12], Title should read:
-- (12) United States Patent
Maeda --

Item (75) Inventor name should read -- Takaaki Maeda --.

This certificate supersedes Certificate of Correction issued February 15, 2005.

Signed and Sealed this

Fourteenth Day of November, 2006

JON W. DUDAS
*Director of the United States Patent and Trademark Office*